US006945714B2

(12) United States Patent
Miyauchi et al.

(10) Patent No.: US 6,945,714 B2
(45) Date of Patent: Sep. 20, 2005

(54) RECORDING APPARATUS

(75) Inventors: Yasuo Miyauchi, Tokyo (JP); Hiroyuki Saito, Tokyo (JP); Kenji Shigeno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 10/614,169

(22) Filed: Jul. 8, 2003

(65) Prior Publication Data

US 2004/0009021 A1 Jan. 15, 2004

(30) Foreign Application Priority Data

Jul. 10, 2002 (JP) ..... 2002-201623

(51) Int. Cl.[7] ..... B41J 11/20
(52) U.S. Cl. ..... 400/55; 400/59; 347/8
(58) Field of Search ..... 400/55–59, 701; 347/8, 19–33

(56) References Cited

U.S. PATENT DOCUMENTS 5,479,194 A * 12/1995 Hirano et al. ..... 347/22
5,751,301 A * 5/1998 Saikawa et al. ..... 347/8
5,872,581 A 2/1999 Yanagi et al. ..... 347/49
5,917,513 A 6/1999 Miyauchi et al. ..... 347/29
6,315,468 B2 * 11/2001 Kishida et al. ..... 400/55
6,406,110 B1 * 6/2002 Ahne et al. ..... 347/8
6,592,198 B2 7/2003 Shoji et al. ..... 347/16
6,629,787 B2 * 10/2003 Lee et al. ..... 400/59

FOREIGN PATENT DOCUMENTS

JP 09188028 A * 7/1997 ..... B41J/25/308
JP 2002002056 A * 1/2002 ..... B41J/25/308

* cited by examiner

*Primary Examiner*—Minh Chau
(74) *Attorney, Agent, or Firm*—Fitzpatrick, Cella, Harper & Scinto

(57) ABSTRACT

A recording apparatus which comprises a recording material or tray conveying roller, a carriage lifting mechanism for changing an interval between the recording unit and the recording material, and a cleaning unit. In the apparatus, in accordance with a separation instruction, an interval between the recording unit and the recording material is changed before a recording operation is started. Further, in the apparatus, a position of the recording unit is returned to a predetermined position before a cleaning operation is started by the cleaning unit. Thereby, a recording apparatus has a simple configuration, and, by performing a simple control process, the function of the cleaning unit is used to ensure the function of the recording unit, even when the interval between the recording unit and the recording material is changed for the recording of a CD, for example.

8 Claims, 22 Drawing Sheets

RECORDING APPARATUS

BACKGROUND OF THE INVENTION

1. Field of the Invention

The present invention relates to a recording apparatus, such as a printer or an image forming apparatus, wherein a tray on which recording materials can be mounted is employed.

2. Related Background Art

Conventionally, various types of recording media have been proposed for use with a recording apparatus such as a printer or an image forming apparatus, and among those media are compact recording media (hereinafter collectively referred to as compact disks or CDs) having a specific thickness, such as CD-Rs, DVDs and cards. For a current general-purpose recording apparatus, when a path for the conveying of cut sheets is employed during the recording of data on a recording material such as a CD, because of the highly rigid construction of the CD, defects occur, i.e., the conveying performance may be deteriorated, surface scratches may be made, or the conveying of the CD may be disabled because the distance between the conveying rollers is inappropriate. Therefore, when a thick, compact recording medium such as a CD is used, a tray is employed to convey the CD along a path separate from the path used for cut sheets.

Since a tray is thicker, in general, than is a cut sheet, some consideration must be given to the procedures employed for inserting a recording material into a conveying roller pair, for the sandwiching of the recording material by the conveying roller pair, and for the acquisition of an appropriate gap between a recording unit (a recording head) and the recording material. While taking these functions into account, a method has been provided according to which an operating lever is provided for a recording apparatus, and the urging force exerted by a conveying member is regulated in consonance with the movement of the operation lever. Thus, after a user has inserted and positioned a tray at a predetermined location, the user again manipulates the operating lever to set the conveying member in the urging state. The user also manipulates the operating lever to raise a carriage whereon a recording head is mounted, so as to obtain an appropriate recording gap (the distance between the recording head and the recording material).

However, in the conventional example, when a user starts a recording operation but forgets to manipulate the operating lever to raise the carriage, the tray collides with and damages the recording head. In order to eliminate this problem, it has been requested that the ascent and descent of the recording head be controlled by a motor, and that, depending on the recording material, a recording head separation instruction signal (an instruction to separate the recording head) be issued so that the separation of the recording head from the tray can be performed automatically. However, in this case, a problem still exists in that the succeeding employment of a cleaning means is required.

Conventionally, there are many apparatuses wherein, in order to perform the recording (the printing) for an envelope, thick paper printing height positioning mechanisms (to set thick paper print positions) are provided that raise recording heads about 1 mm. According to the configurations used for these apparatuses, cleaning means (recovery means) for cleaning the recording head (recovery process) is raised to a position corresponding to that of the recording head. However, for a recording apparatus compatible with CD printing, it is difficult to track the cleaning means up to a position (a height) about 3 mm higher, i.e., to the same height to which the recording head is raised and positioned. As a result, leakage occurs, due to insufficient capping pressure (the bonding force between the recording head and the cap), as does a wiping failure, due to the insufficient distance (insufficient overlapping distance) parts are moved to provide an interval for the entrance of the wiper blade that cleans the recording head. While the tracking range for the recovery means could be extended by using a mechanical arrangement, because the size of this arrangement would cause its configuration to become complicated, accordingly, the manufacturing costs and the size of the recording apparatus would be increased.

SUMMARY OF THE INVENTION

It is, therefore, one objective of the present invention to provide a simply configured recording apparatus, wherein, by performing a simple control process, the performance can be maintained of the cleaning means function used to ensure the recording means function is performed, even when an interval between recording means and recording material is changed so that a tray, for recording media, can be causing in the same manner as when a compact disc (CD) is recorded.

To achieve this objective, according to the present invention, a recording apparatus for causing a recording unit to record data on a recording material comprises:

a conveying roller for conveying a recording material or a tray on which a recording material is mounted;

a carriage lifting mechanism for changing an interval between the recording unit and the recording material; and a cleaning unit for maintaining/recovering a function of the recording unit, wherein, in accordance with a separation instruction for separating the recording unit from the recording material, an interval between the recording unit and the recording material is changed before a recording operation performed by the recording unit is started, and wherein the recording unit is repositioned to a predetermined position before a cleaning unit operation is started.

According to the present invention, the recording apparatus for employing the recording unit for the recording of the recording material is designed so that the apparatus comprises:

a conveying roller for conveying a recording material or a tray on which the recording material is mounted, a carriage lifting mechanism for changing an interval between the recording unit and the recording material, and a cleaning unit, for maintaining/recovering the function of the recording unit, that, in accordance with a separation instruction for separating the recording unit from the recording material, an interval between the recording unit and the recording material is changed before a recording operation by the recording unit is started; and that, for positioning, the recording unit is returned to a predetermined position before a cleaning operation by the cleaning unit is started. Therefore, a recording apparatus having a simple configuration can be provided wherein, by performing a simple control process, the function of the cleaning unit is used to ensure the function of the recording unit can be maintained, even when the interval between the recording unit and the recording material is changed, so that a tray is used for the recording of a recording material in the same manner as is the recording of a CD.

DETAILED DESCRIPTION OF THE PREFERRED EMBODIMENTS

Figure 1:
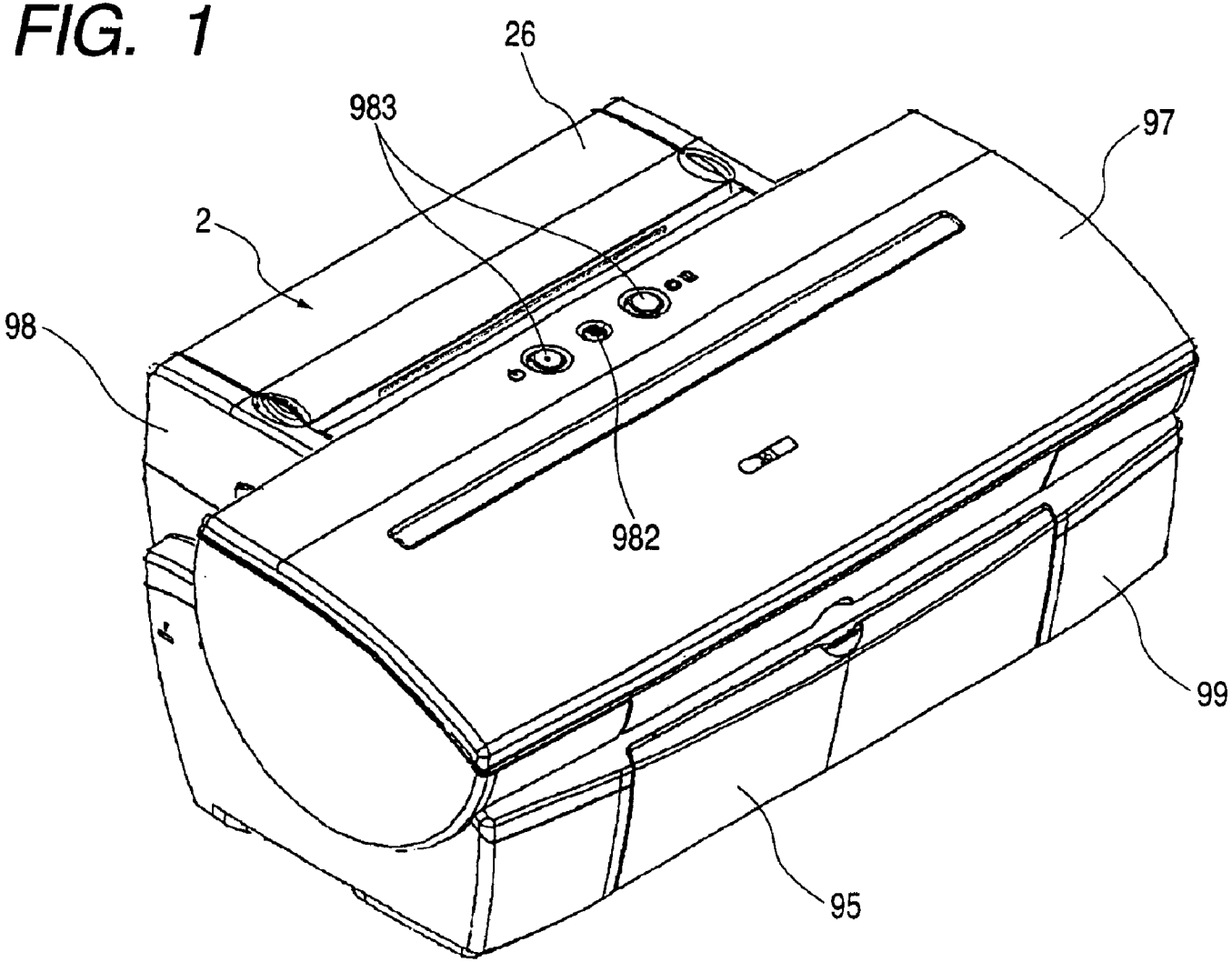
FIG. 1 is a perspective view of a recording apparatus according to a first embodiment of the present invention.

The preferred embodiments of the present invention will now be described while referring to the accompanying drawings. The same reference numerals are employed throughout to denote corresponding or identical sections.

(First Embodiment)

Figure 2:
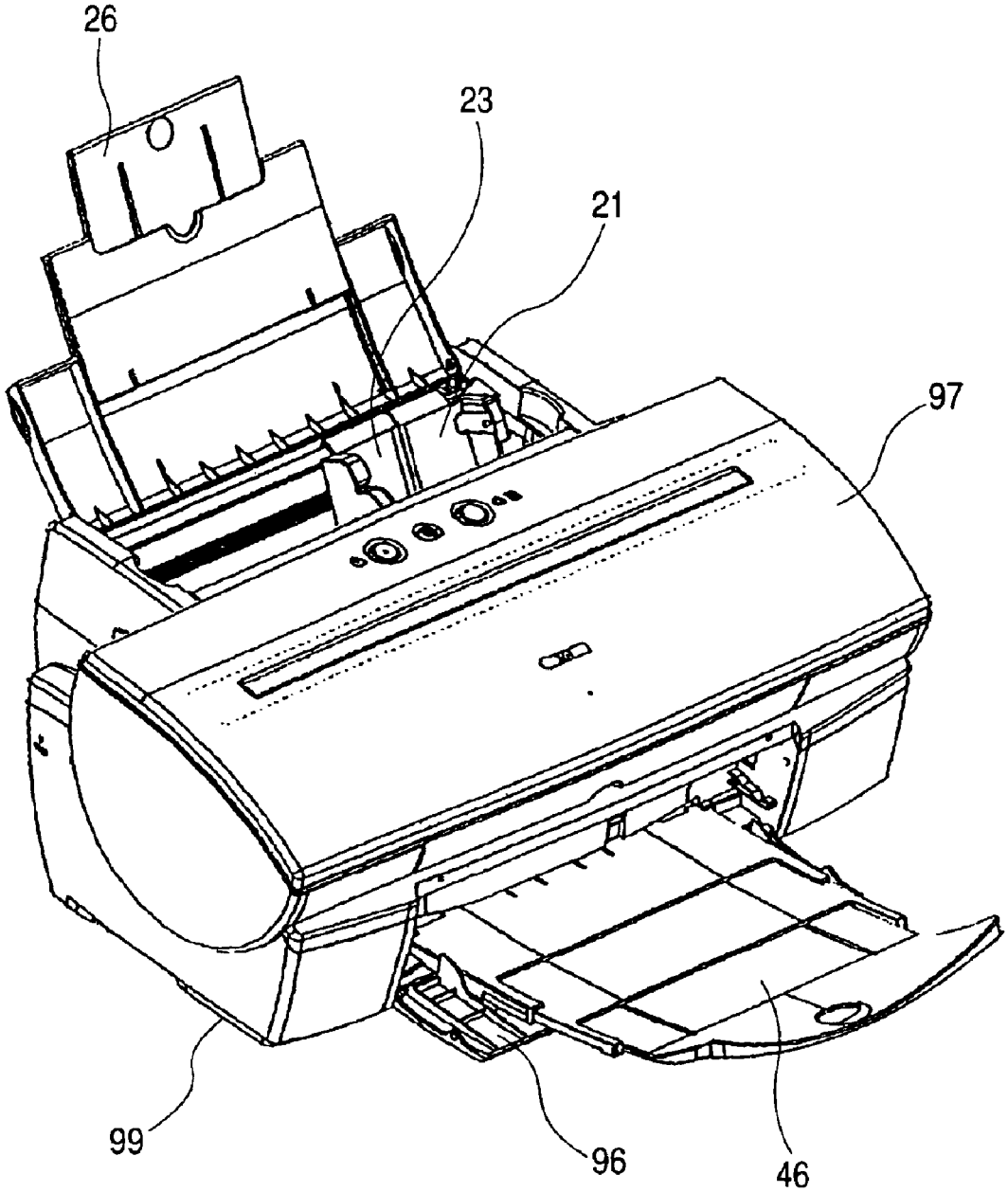
FIG. 2 is a perspective view of the state of the recording apparatus in FIG. 1 wherein a sheet feed tray and a sheet discharge tray have been opened.
Figure 3:
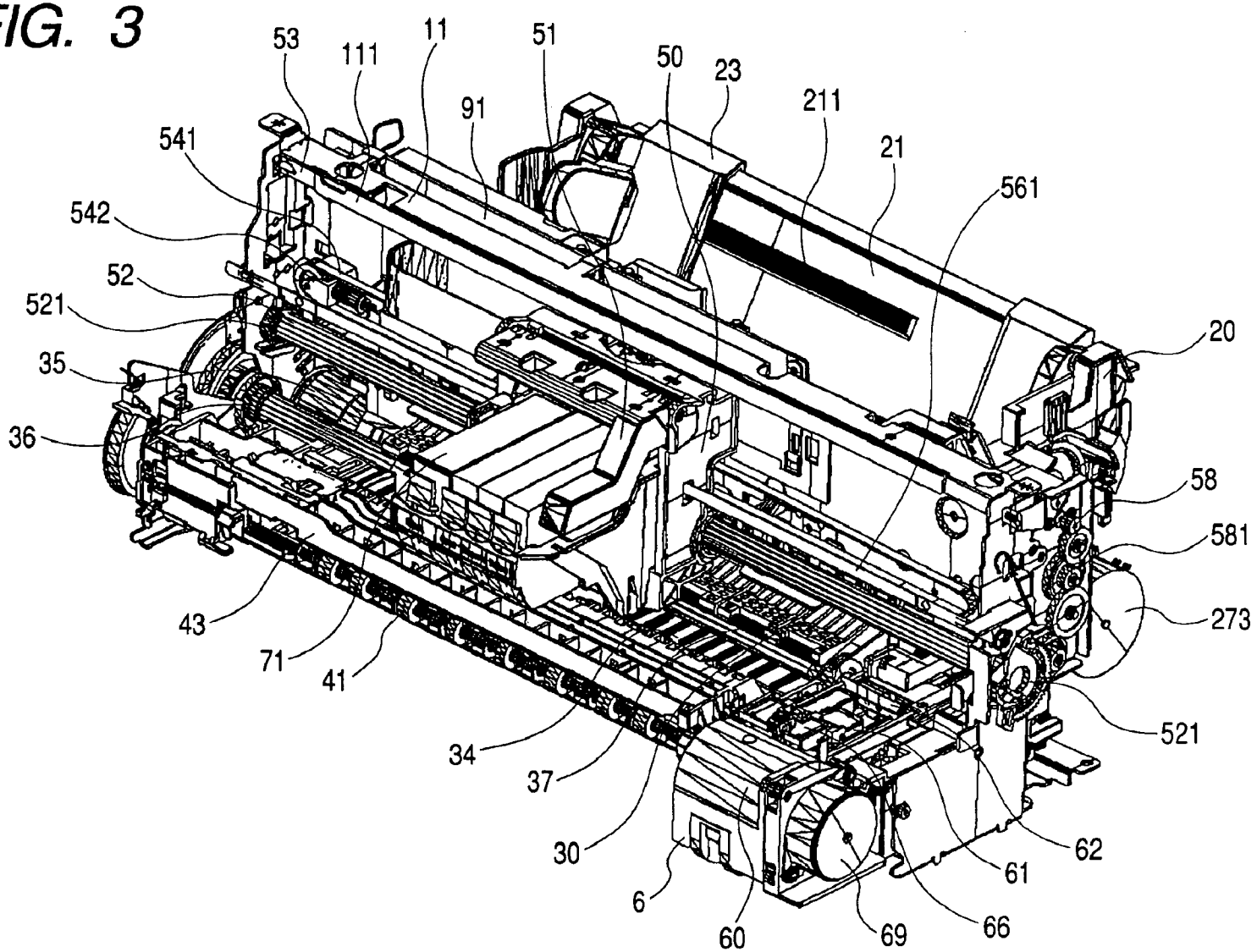
FIG. 3 is a perspective view, from the right front, of the internal mechanism of the recording apparatus in FIG. 3.
Figure 4:
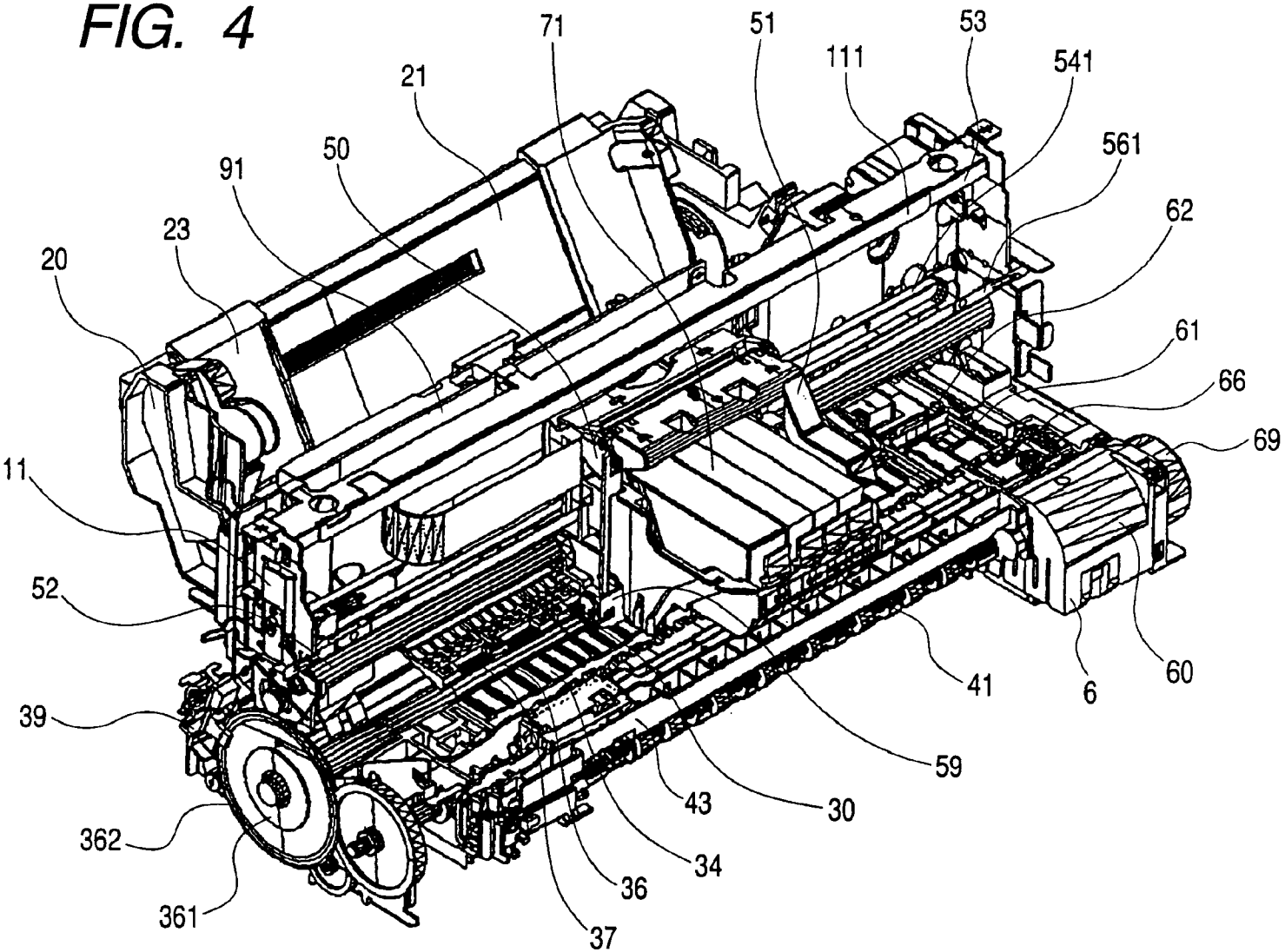
FIG. 4 is a perspective view, from the left front, of the internal mechanism of the recording apparatus in FIG. 3.
Figure 5:
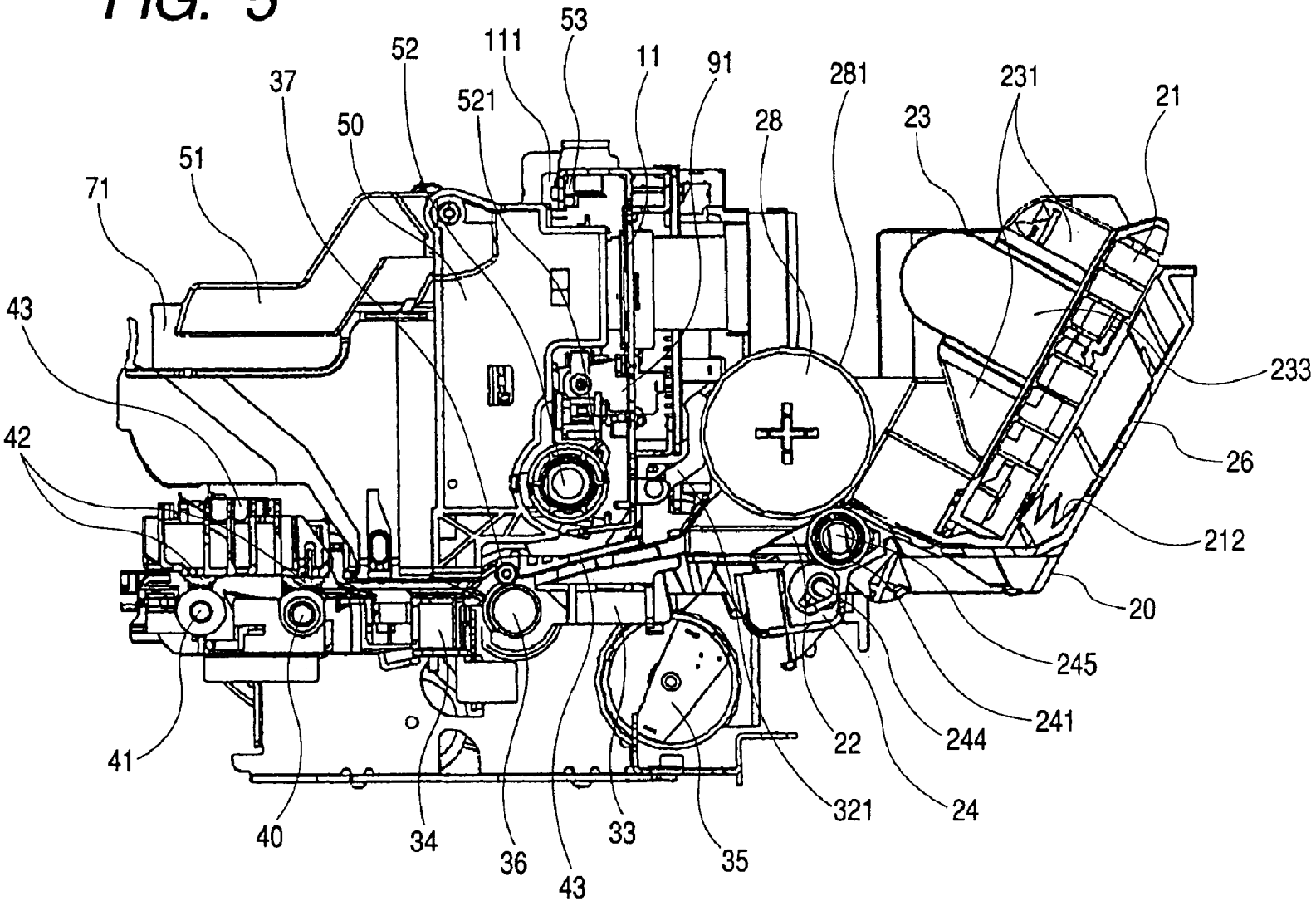
FIG. 5 is a vertical cross-sectional view of the recording apparatus shown in FIG. 3.
Figure 6A:
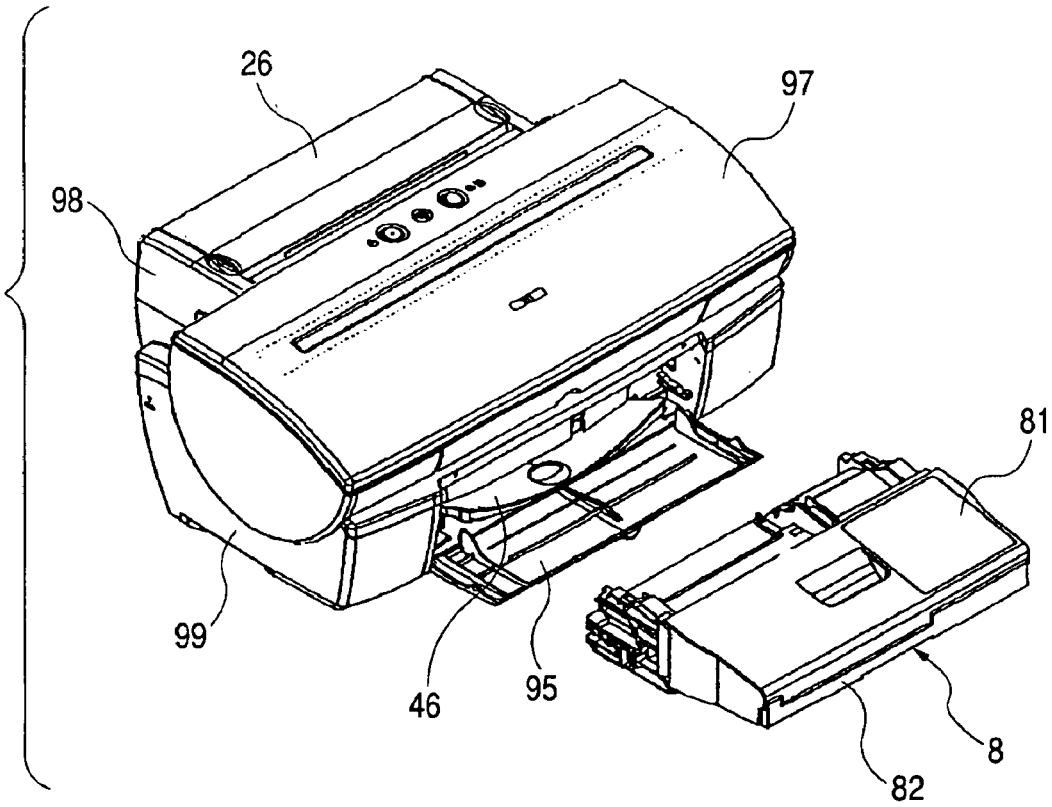
FIG. 6A is a perspective view of the recording apparatus in FIG. 1 before a compact disc (CD) conveying unit has been attached thereto.
Figure 6B:
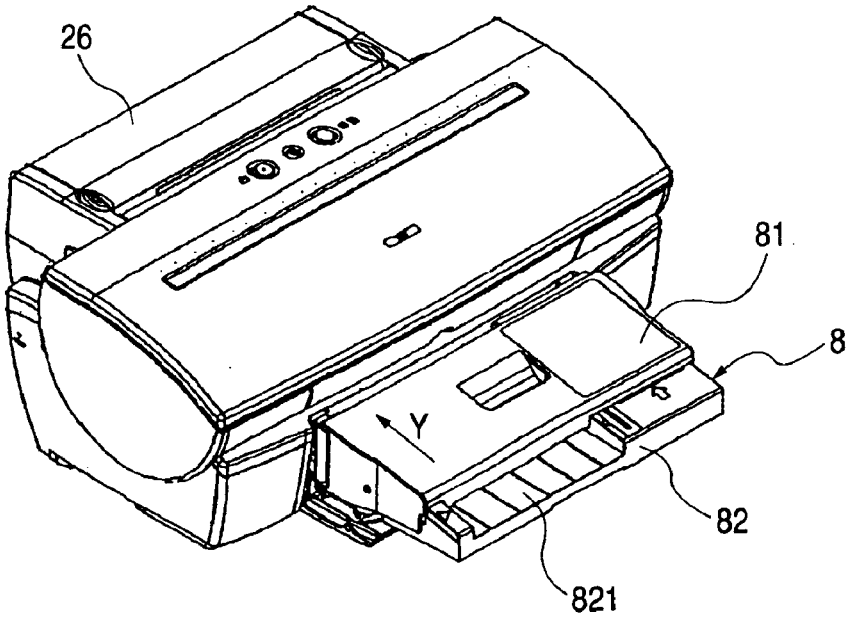
FIG. 6B is a perspective view of the recording apparatus in FIG. 1 after the CD carrier unit has been is attached thereto.
Figure 7:
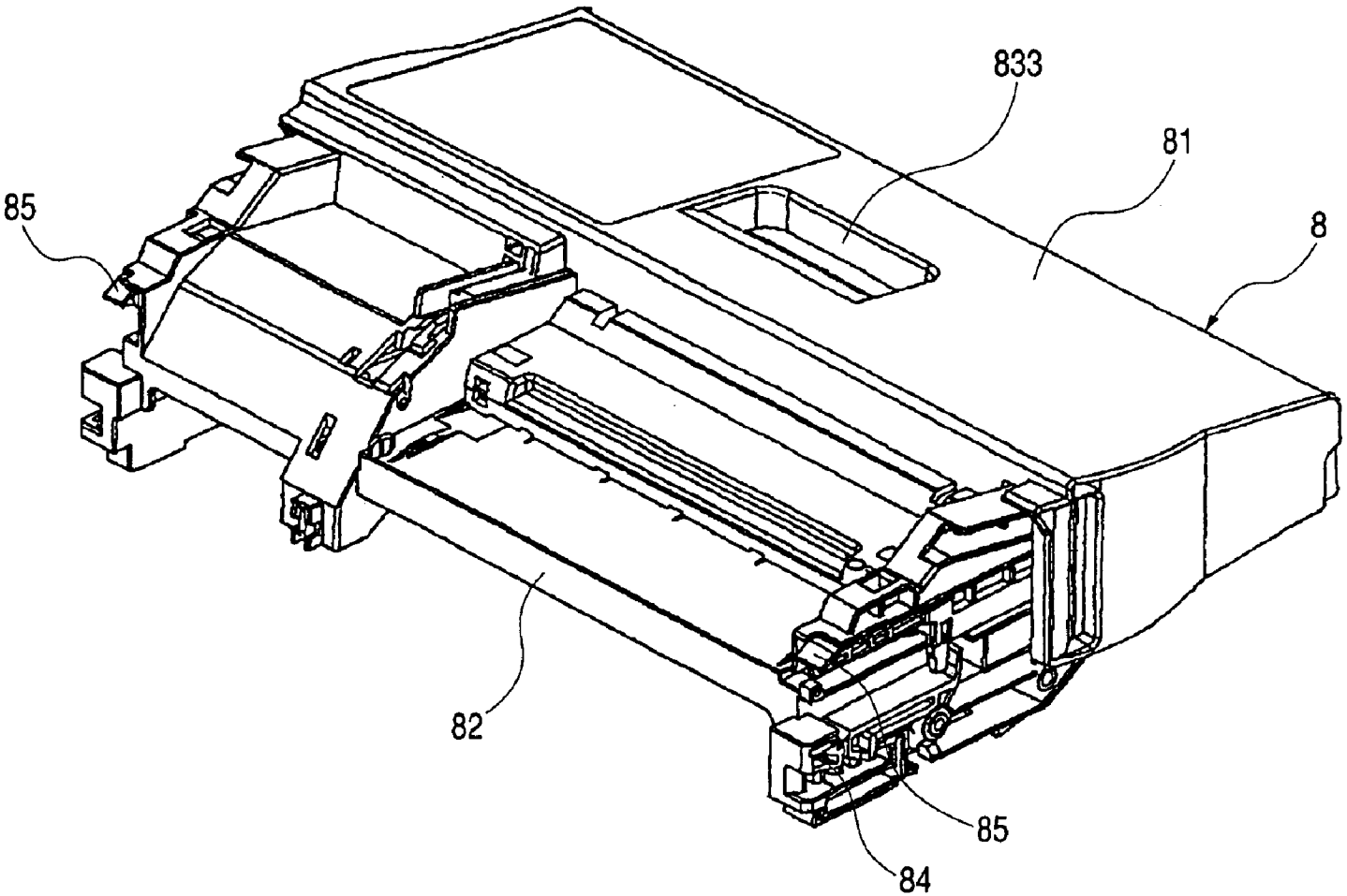
FIG. 7 is a perspective view of a CD carrier unit that can be attached to the recording apparatus in FIG. 1.

FIG. 1 is a perspective view of a recording apparatus according to a first embodiment of the present invention. FIG. 2 is a perspective view of the recording apparatus in FIG. 1 wherein a sheet feed tray and a sheet discharge tray have been opened. FIG. 3 is a perspective view, from the right front, of the internal mechanism of the recording apparatus in FIG. 1, and FIG. 4 is a perspective view, from the left front, of the internal mechanism of the recording apparatus in FIG. 3. FIG. 5 is a vertical cross-sectional view of the recording apparatus in FIG. 3, FIGS. 6A and 6B are perspective views of the recording apparatus 1 before and after a compact disc (CD) conveying unit 8 is attached thereto, and FIG. 7 is a perspective view of the CD carrier unit 8 that can be attached to the recording apparatus in FIG. 1.

Figure 21:
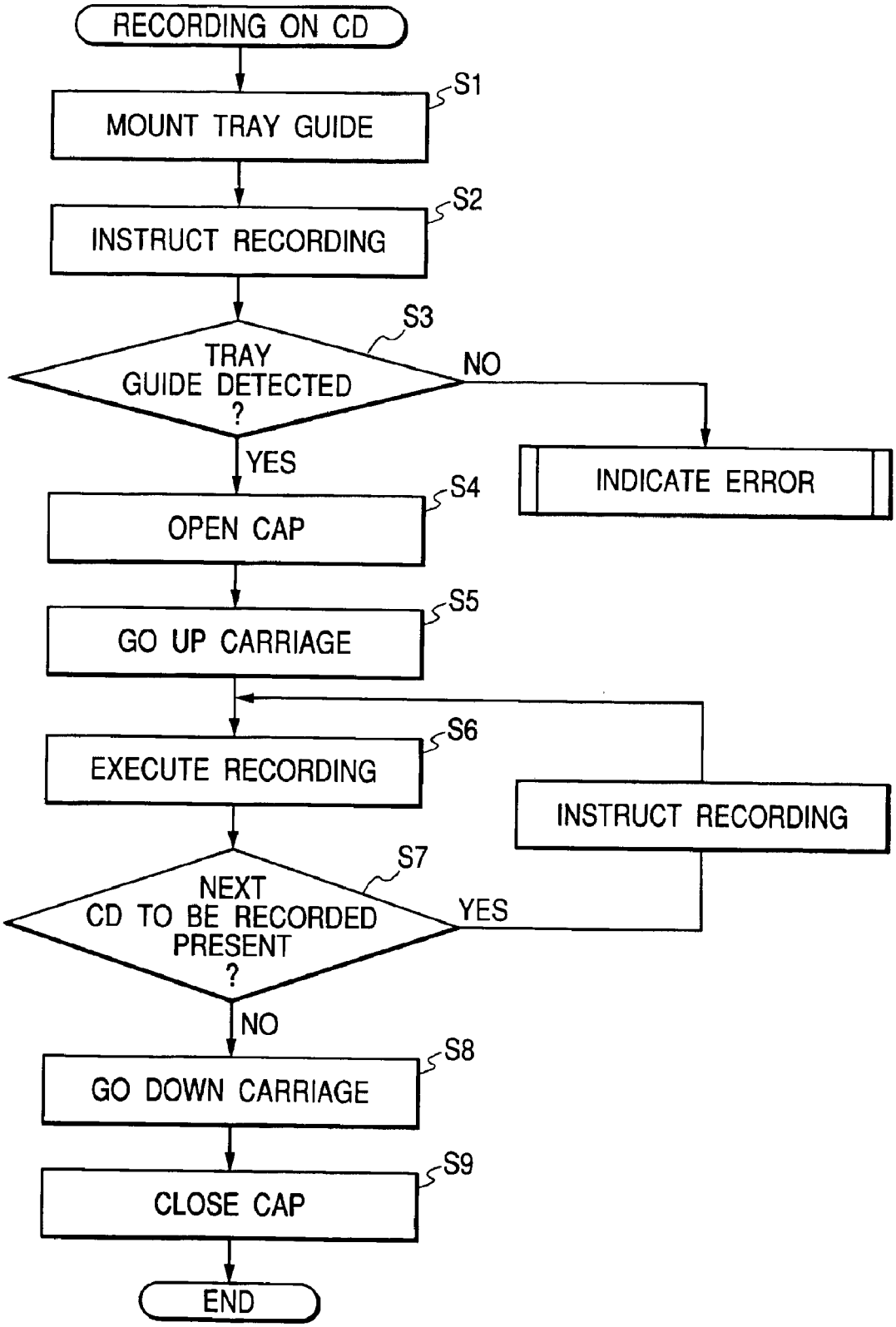
FIG. 21 is a flowchart showing the operation, performed by the recording apparatus according to the first embodiment of the present invention, for the ascent and descent of the carriage in which the recording unit is mounted.
Figure 22:
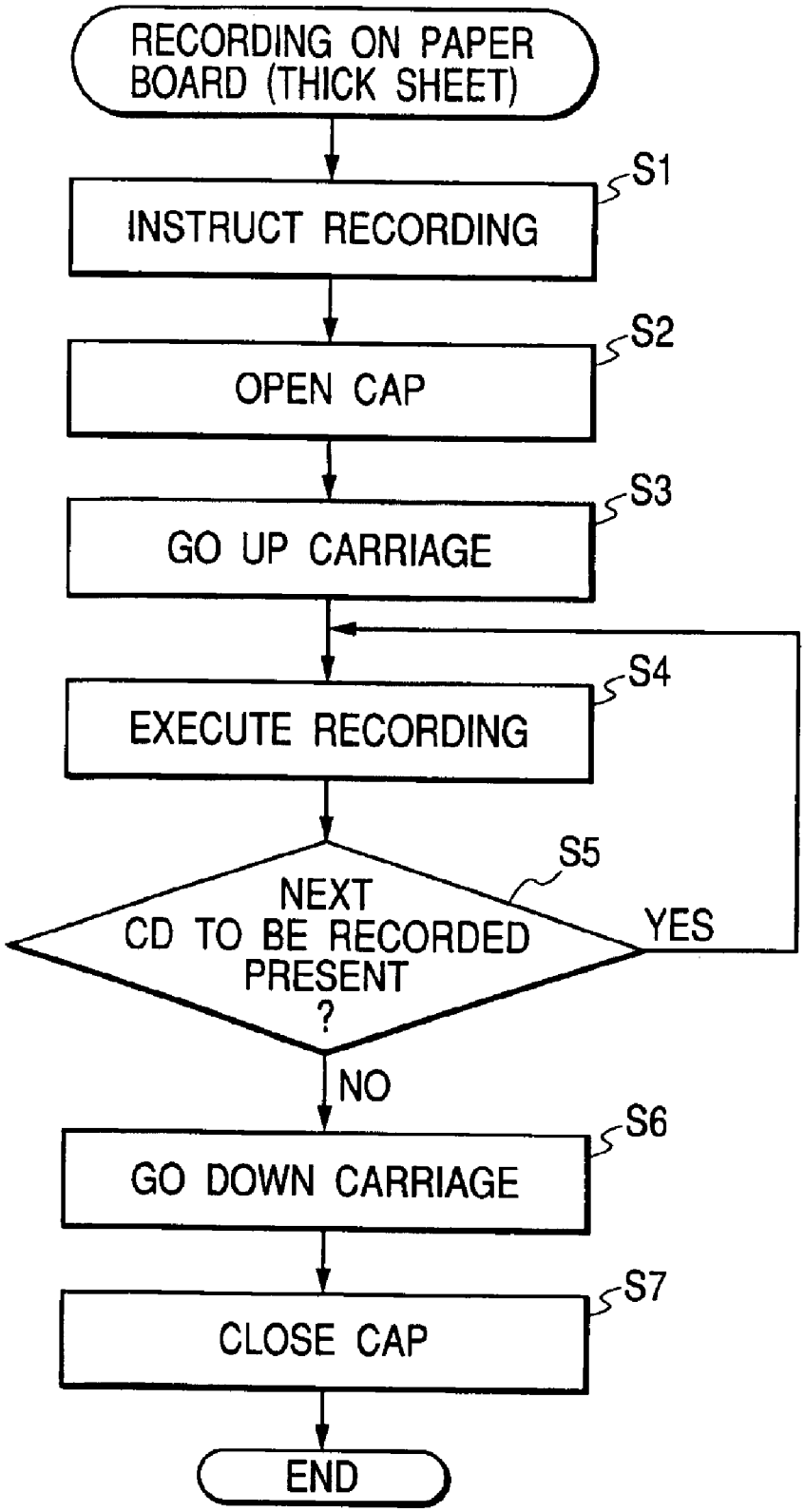
FIG. 22 a flowchart showing the operation, performed by a recording apparatus according to a second embodiment of the present invention, for the ascent and descent of a carriage in which a recording unit is mounted.

FIGS. 8 to 19 are drawings for explaining the CD printing configuration and operation of the recording apparatus according the first embodiment of the present invention. FIGS. 21 and 22 are flowcharts for explaining the control process sequences performed by the recording apparatuses according to the first and second embodiments of the present invention for the ascent and descent of a carriage in which a recording unit is mounted. In FIGS. 1 to 5, a recording apparatus 1 according to this embodiment comprises: a sheet feeding unit 2, a sheet conveying unit 3, a sheet discharge unit 4, a carriage unit 5, a recovery unit (cleaning unit) 6, a recording unit (recording head) 7, a CD carrier unit 8 and an electric unit 9. An overview, in accordance with the subdivisions, of these individual sections will now be sequentially described.

(A) Sheet Feeding Unit

The design of the sheet feeding unit 2 provides a pressing plate 21, on which sheets P are mounted, that is attached to a base 20, a sheet feeding roller 28 for supplying a sheet P, a separation roller 241 for separating the sheet P, and a return lever 22 for returning the sheet P to the mounting position. A sheet feed tray 26 for holding the mounted sheets P is attached to the base 20 or to the cover of the recording apparatus case. As is shown in FIG. 2, the sheet feed tray 26 has multiple stages, and for use, is pulled out.

The sheet feeding roller 28 is an arc-shaped rod, in cross section, and one rubber supply roller 281 is provided for the sheet feeding roller 28 near a sheet guide reference. The thus arranged sheet feeding roller 28 is employed to supply (feed) a sheet P, and is driven by a driving force, transmitted via a transmission gear 271 and a planetary gear 272, that is supplied by a sheet feed motor 273 provided for the sheet feeding unit 2. A movable side guide 23 is provided for the pressing plate 21 to regulate the position whereat the sheets P are mounted. The pressing plate 21 is impelled, by a pressing plate spring 212, toward the sheet feeding roller 28, and can be rotated at a rotation shaft connected to the base 20. At the portion of the pressing plate 21 facing the sheet feeding roller 28, a separation sheet 213, composed of a material, such as artificial leather, having a large friction coefficient, is disposed so as to prevent the feeding of several sheets P from the top of the sheet P stack. A pressing plate cam 214 is used to bring the pressing plate 21 into contact with and to separate it from the sheet feeding roller 28.

In addition, a separation roller 241 for individually separating the sheets P is attached to a separation roller holder 24, which is urged toward the sheet feeding roller 28 by a separation roller spring 241, can be rotated at the rotation shaft of the base 20. A separation roller clutch (clutch spring) 243 is attached to the separation roller 241, and when a predetermined, or greater, load is imposed on the separation roller 241, the portion of the separation roller clutch 243 attached to the separation roller 241 can be rotated. A separation roller release shaft 244 and a control cam 25 are used to bring the separation roller 241 into contact with or to separate it from the sheet feeding roller 28. An ASF sensor 29 detects the positions of the pressing plate 21, the return lever 22 and the separation roller 241, while the return lever 22 for returning a sheet P to the mounting position is rotatably provided on the base 20, and is urged in the unlocking direction by a return lever spring 221. To return a sheet P to the mounting position, the return lever 22 is rotated by the control cam 25.

With this configuration, the sheet feeding operation will now be described. In the normal standby state, the pressing plate 21 is released by the pressing plate cam 214 and the separation roller 241 is released by the control cam 25, while the return lever 22 is positioned so that the sheets P are returned to the mounted position and the mounting port is blocked, so that after having been mounted, the sheets P are prevented from moving further forward. When sheet feeding is begun in this state, first, the separation roller 241 is brought into contact with the sheet feeding roller 28 by the sheet feed motor 273. Then, the return lever 22 is released and the pressing plate 21 is brought in contact with the sheet feeding roller 28. In this state, the supply of the sheets P is begun. The supply of the sheets P is controlled by a pre-state separator 201 provided for the base 20, and only a predetermined number of sheets P are fed to a nip portion constituted by the sheet feeding roller 28 and the separation roller 241. The sheets P are separated at the nip portion, and only the topmost sheet P is conveyed (supplied).

When a sheet P reaches a convey roller pair comprising a convey roller 36 and pinch rollers 37, which will be described later, the pressing plate 21 and the separation roller 28 are respectively released by the pressing plate cam 214 and the control cam 25, and the return lever 22 is returned to the mounting position by the control cam 25. At this time, a sheet P that has reached the nip portion, formed by the sheet feeding roller 28 and the separation roller 241, can be returned to the mounting position.

(B) Sheet Conveying Unit

The sheet conveying unit 3 is attached to a chassis 11, made of a bent metal plate, for which the conveying roller 36, for conveying the sheet P, and a PE sensor 32 are provided. The conveying roller 36 is made by coating the surface of a metal shaft with small ceramic particles, and is attached to the chassis 11 by accepting the metal portions at a bearing 38. A conveying roller tension spring 381, provided between the bearing 38 and the conveying roller 36, urges the conveying roller 36 forward and stably imposes a predetermined rotational load thereon, so that sheets P can be stably conveyed.

A plurality of pinch rollers 37 are provided that contact the convey roller 36 and are interlockingly rotated. The pinch rollers 37 are held by a pinch roller holder 30, and are brought into contact with the conveying roller 36 by a pinch roller spring 31, so that the force is generated for conveying a sheet P. In this case, the pinch roller holder 30 is rotated while the rotational shaft is fitted into the bearing of the chassis 11. A paper guide flapper 33 and a platen 34 for guiding the sheet P are arranged at the entrance of the sheet conveying unit 3 to which the sheet P is conveyed, and a PE sensor lever 321 is provided for the pinch roller holder 30 to detect the leading edge and the trailing edge of the sheet P and to notify the PE sensor 32. The platen 34 is positioned by attaching it to the chassis 11, while the paper guide flapper 33 is positioned by abutting the chassis 11. The paper guide flapper 33 can engage the convey roller 36 and be rotated at a slidable bearing 331.

A sheet holder 341 that covers the edge of the sheet P is located on the sheet reference side of the platen 34. This sheet holder 341 prevents a deformed or curled edge of a sheet P from raising and touching the carriage 50 or the recording head 7. Downstream of the convey roller 36, in the direction in which the sheet P is conveyed, the recording head 7 is located that forms an image based on image data.

With the above configuration, a sheet P transmitted to the sheet conveying unit 3 is guided to the pinch roller holder 30 and the paper guide flatter 33, and is then conveyed to the roller set comprising the convey roller 36 and the pinch rollers 37. At this time, the PE sensor lever 321 detects the leading edge of the sheet P, and the recording position (the printing position or the image forming position) of the sheet P is obtained. Further, as the set of rollers 36 and 37 is rotated by a conveying motor 35, the sheet P is conveyed along the platen 34, where a rib serving as a conveying reference face is formed. This rib is used to manage a gap from the recording head 7, and is also used, together with the sheet discharge unit that will be described later, to prevent the sheet P from becoming corrugated.

When the rotation force of the conveying motor 35, which is a DC motor, is transmitted along a timing belt to a pulley 361 that is arranged on the shaft of the convey roller 36, the conveying roller 36 is driven. Further, a code wheel 362 is also arranged on the shaft of the conveying roller 36 to detect the distance the conveying roller 36 is rotated, and marks are formed on the code wheel 362 at pitches of 150 to 300 lpi. In addition, an encoder sensor for reading the marks is attached to the chassis 11 at a position adjacent to the code wheel 362.

In this embodiment, an ink jet recording head is employed as the recording unit (recording head) 7. For the recording head 7, replaceable ink tanks 71 are provided for the individual ink colors, and based on recorded data, ink can be heated by a heater (heat generating element). When film-boiling of ink is performed using the heat, and the film-boiling causes the pressure to change by expanding or reducing the sizes of bubbles, ink droplets are ejected from the orifices of the recording head 7 to form an image on a sheet P.

(C) Carriage Unit

The carriage unit 5 includes a carriage 50 to which the recording head 7 is attached. The carriage 50 is reciprocally moved in the main scanning direction by a guide shaft 52 along a guide rail 111 that is arranged perpendicular to the direction in which the sheet P is conveyed. The guide rail 111 also has a function for supporting the rear end of the carriage 50 to maintain an appropriate value for the gap (inter-sheet distance) between the recording head 7 and a sheet P. The guide shaft 52 is attached to the chassis 11, and the guide rail 111 is integrally formed with the chassis 11. A thin slide sheet plate made of SUS, for example, is extended along the side of the guide rail 111, along which the carriage 50 is moved, to reduce the noise produced by the sliding.

The carriage 50 is driven along a timing belt 541, supported by an idle pulley 542, by a carriage motor 54 provided for the chassis 11. The timing belt 541 and the carriage 50 are coupled by a damper 55 made of rubber, for example, and when the vibration of the carriage motor 54 is attenuated, the occurrence of uneven images is reduced. Further, in order to detect the position of the carriage 50, a code strip 561 on which marks are formed at pitches of 150 to 300 lpi is provided in parallel to the timing belt 541, and an encoder sensor 56 for reading the code strip 561 is provided for a carriage board 92 mounted on the carriage 50. A contact 921 is also formed on the carriage board 92 to establish an electrical connection with the recording head 7. In addition, a flexible board 57 is provided for the carriage 50 for the transmission of head signals from an electric portion (electric board) 9 to the recording head 7.

In order to fix the recording head 7, which is a recording unit, to the carriage 50, an abutting portion 501 for positioning and a pressing unit (head pressing unit) 511 for applying a pressing force to hold the recording head 7 are provided for the carriage 50. The pressing unit 511 is mounted on a head set lever 51, and exerts an urging force against the recording head 7 when the head set lever 51 is rotated at the rotation fulcrum to set the recording head 7. An eccentric cam R (right eccentric cam) 521 and an eccentric cam (left eccentric cam) 522 are located at both ends of the guide shaft 52, and when the driving force produced by a carriage lifting motor 58 is transmitted through a gear string 581 to the eccentric cam R 521, the guide shaft 52 ascends or descends. As the guide shaft 52 ascends or descends, the carriage 50 also ascends or descends, so that an optimal gap can be formed for sheets P having different thicknesses.

Furthermore, provided for the carriage 50 is a tray position detector 59, which is a reflective light sensor for detecting a position detection mark 834 for a CD printing tray 83 that is used to record (print) data on the display portion of a thick, compact recording material, such as a CD-R. A light-emitting element on the tray position detector 59 emits light and receives reflected light to detect the position of the tray 83. With this configuration, to form an image on a sheet P, the sheet P is conveyed by the roller set (the convey roller 36 and the pinch rollers 37) to the position of a recording line (the position to which the sheet P is conveyed), and the carriage 50 is moved by the carriage motor 54 to the recording (image forming) position (a position perpendicular to the direction in which the sheet P is conveyed), so that the recording head 7 is located facing the recording position (the image forming position). Thereafter, upon the reception of a signal from the electric portion (electric board) 9, the recording head 7 ejects ink onto the sheet P, and thus, recording (image forming) is performed.

(D) Sheet Discharge Unit

The sheet discharge unit 4 includes: two discharge rollers 40 and 41, which are attached to the platen 34; spurs (or gears) 42 that can be interlockingly rotated while in contact, under a predetermined pressure, with the discharge rollers 40 and 41; and a gear string for transmitting the drive force from the conveying roller 36 to the discharge rollers 40 and 41. The discharge roller 40 upstream, in the conveying direction, is formed by fitting multiple rubber rings (discharge roller rubbers) 401 around a metal shaft, and is driven when the drive force of the convey roller 36 is transmitted to it via an idler gear. The discharge roller 41 is formed by fitting, on a resin shaft, multiple flexible members 411 made of a material such as elastomer, and is driven when the drive force of the discharge roller 40 is transmitted to it via the idler gear.

The spurs 42 can be produced by integrally forming resin portions and thin SUS plates, for example, around the circumferences of which multiple raised portions are formed. These spurs 42 are attached to a spur holder 43, and in this embodiment, a gear spring 44, which is a rod-like coil spring, is employed to attach the spurs 42 to the spur holder 43 and to press the spurs 42 against the discharge rollers 40 and 41. Further, in this embodiment, one of the spurs 42 mainly generates the conveying force for the sheet P, and the other spur 42 mainly prevents the raising of the sheet P during the recording operation. The first spur 42 is located at a position corresponding to that of the rubber rings 401 (discharge roller rubbers and the flexible members) of the sheet discharge rollers 40 and 41, and the second spur 42 is located at a position (between the rubber rings 401) where the rubber rings 401 of the sheet discharge rollers 40 and 41 are not provided.

A sheet edge supporter 45 is located between the sheet discharge rollers 40 and 41. This sheet edge supporter 45 raises the two ends of the sheet P and holds the sheet P between the sheet discharge rollers 40 and 41, to prevent it from rubbing the portion of the preceding sheet P on which an image has been recorded, so that the image is not damaged or the image quality deteriorated. That is, a sheet edge support spring 452 of the sheet edge supporter 45 presses against a resin member, where a roller 451 is formed at the distal end, and pushes the roller 451 against the sheet P by applying a predetermined pressing force. Thus, the two ends of the sheet P are raised, so that the sheet P can be firmly held.

With this configuration, a sheet P for which recording (image forming) has been performed by the carriage unit 5 is then sandwiched by the nip portion formed by the sheet discharge roller 41 and the spurs 42, and is conveyed forward and discharged to a sheet discharge tray 46. The sheet discharge tray 46, which has a segmented structure including multiple members, is stored under a lower case 99 of the recording apparatus and is pulled out for use. The height of the sheet discharge tray 46 in FIG. 2 is increased toward the distal end, as are the heights of the side edges of the sheet discharge tray 46. With this structure, the sheets P can be stacked after they are discharged, and rubbing of the recorded faces of the sheets P can be prevented.

(E) Recovery Unit (Cleaning Unit)

The recovery unit (cleaning unit) 6 includes: a pump (e.g., a suction pump as a negative pressure generation source), for performing the suction recovery process (cleaning process) to maintain or recover the ejection function of the recording head 7; a cap 61, for protecting the orifice face of the recording head 7 and preventing the drying of the orifice face; a wiping section (blade) 62, for removing (cleaning off) particles, such as ink and dust, attached to the orifices on the orifice face of the recording head 7; a special recovery motor 69; and a one-way clutch 691, which is used to activate the pump 60 when the recovery motor 69 rotates in one direction and to start the wiping, using the blade 62, and the ascent or descent of the cap 61 when the recovery motor 69 rotates in the other direction.

In this embodiment, the pump 60 exerts a negative pressure by stroking two tubes 67 using a pump roller 68, and a valve 65 is provided along the suction path (e.g., the tubes) from the cap 61 to the pump 60. In this suction recovery unit 6, while the cap 61 is closely attached to the orifice face of the recording head 7 (capping state), the pump 60 is operated to generate the negative pressure in the cap 61, and under the negative pressure, viscous ink and foreign substances, such as bubbles and dust, can be collected and discharged together with the residual ink from the orifices of the recording head 7.

In the cap 61, a cap absorption member 611 is provided to reduce the amount of residual ink on the orifice face of the recording head 7 after the ink suction has been performed. Further, in order to prevent a problem resulting from the sticking of residual ink to the cap absorption member 611 that is provided, an idle suction operation of the suction pump 60 is performed while the cap 61 is opened, so that residual ink in the cap 61 is removed. The waste ink discharged by the pump 60 is absorbed and held by a waste ink absorption member 991 provided for the lower case 99, which will be described later.

The recovery process sequence performed by the recovery unit 6, i.e., the wiping process using the blade 62, the attachment/removal (ascent/descent operation) of the cap 61, and the opening/closing of the valve 65 between the cap 61 and the pump 60, are performed by a main cam 63 formed of a plurality of cams arranged along the same axis. When the cams and the arm (lever) located at positions corresponding to the recovery processes are operated by the main cam 63, predetermined recovery processes can be performed.

The position, such as the recovery position, of the main cam 63 can be detected by a position detector 64, such as a photointerrupter. When the cap 61 is separated from the recording head 7 (has descended in this embodiment), the blade 62 is moved in the direction perpendicular to the main scanning direction of the carriage 5, and cleans the orifice face of the recording head 7 (the cleaning process). In this embodiment, the blade 62 is formed of a plurality of blades, i.e., a blade for cleaning the orifices of the recording head 7 and a blade for the overall cleaning of the orifice face. When the blade 62 is moved to the rearmost position, the blade 62 abuts upon a blade cleaner 66, so that the ink (transferred ink) attached to the blade 62 can be removed and the wiping function of the blade 62 can be recovered.

(F) Case cover

The sections and the mechanisms (units) described above are assembled in the chassis 11 of the recording apparatus 1 to form the mechanical portion of the recording apparatus 1. The case cover is attached to close the mechanical portion, and mainly comprises the lower case 99, an upper case 98, an access cover 97, a connector cover 96 and a front cover 95. Discharge tray rails 992 are located at the lower portion of the lower case 99, and the sheet discharge tray 46, of sliding type, can be stored along the discharge tray rails 992. Further, the front cover 95 is designed so that it blocks the discharge port when not in use.

The access cover 97 is rotatably attached to the upper case 98. An opening is formed in part of the upper face of the upper case 98, and through the opening, the ink tanks 71 and the recording head 7 can be exchanged. The upper case 98 also includes: a door switch lever 981 for detecting the opening/closing of the access cover 97; an LED guide 982, for transmitting and displaying the light from the LED; and a key switch 983, for acting as the SW of the electric portion (circuit board) 9.

The sheet feed tray 26, composed of multiple stages, is rotatably attached to the upper case 98, and when the sheet feed tray 26 is stored while the sheet feeding unit 2 is not in use, the sheet feed tray 26 functions as the cover of the sheet feeding unit 2. The upper case 98 and the lower case 99 are attached by flexible engagement pawls, and the portion where the connector is provided, between the upper case 98 and the lower case 99, is covered by the connector cover 96.

Figure 8:
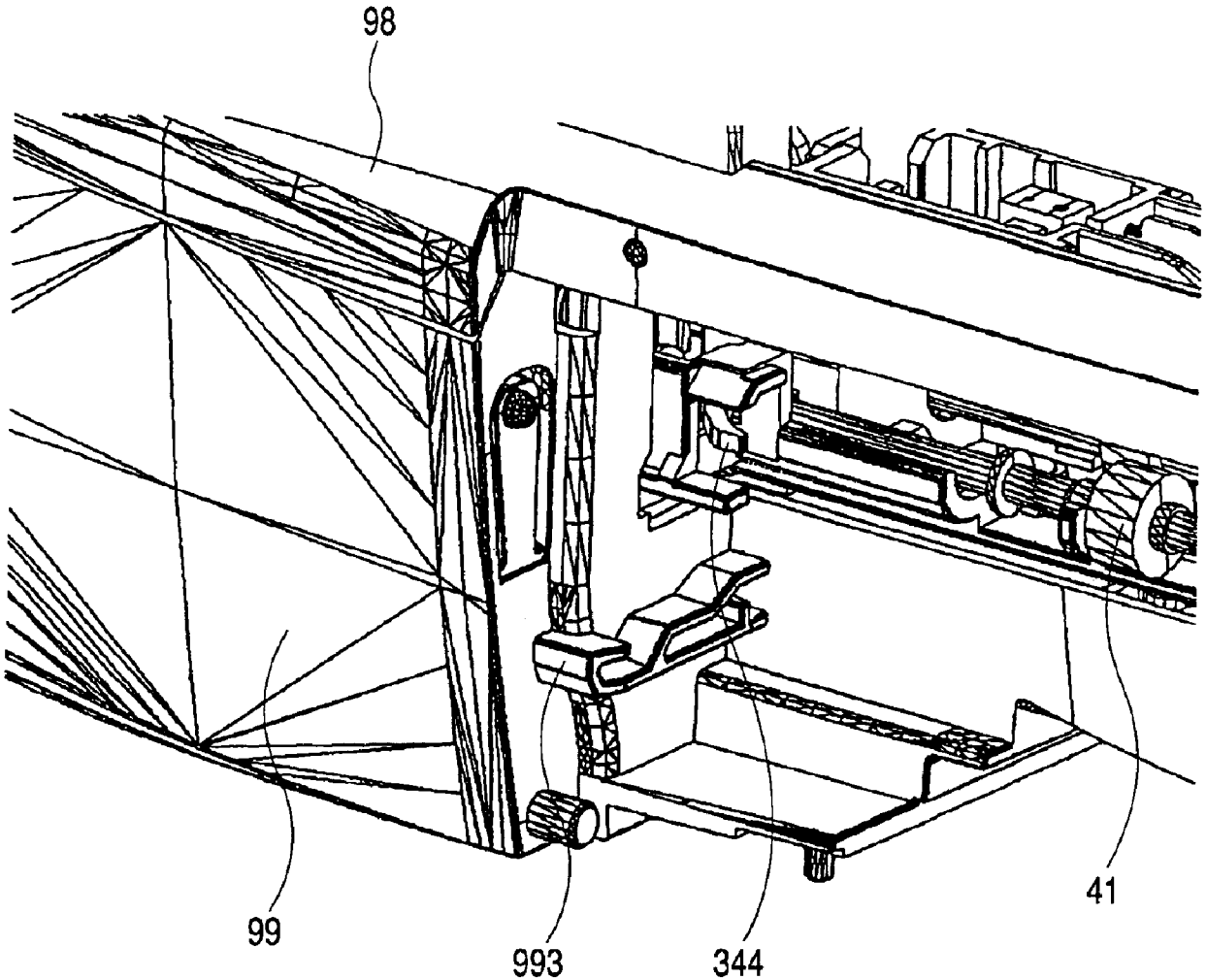
FIG. 8 is a partial perspective view of the portion of the lower case of the recording apparatus according to the first embodiment of the present invention, wherein the CD carrier unit is to be attached and the attachment is to be detected.
Figure 9:
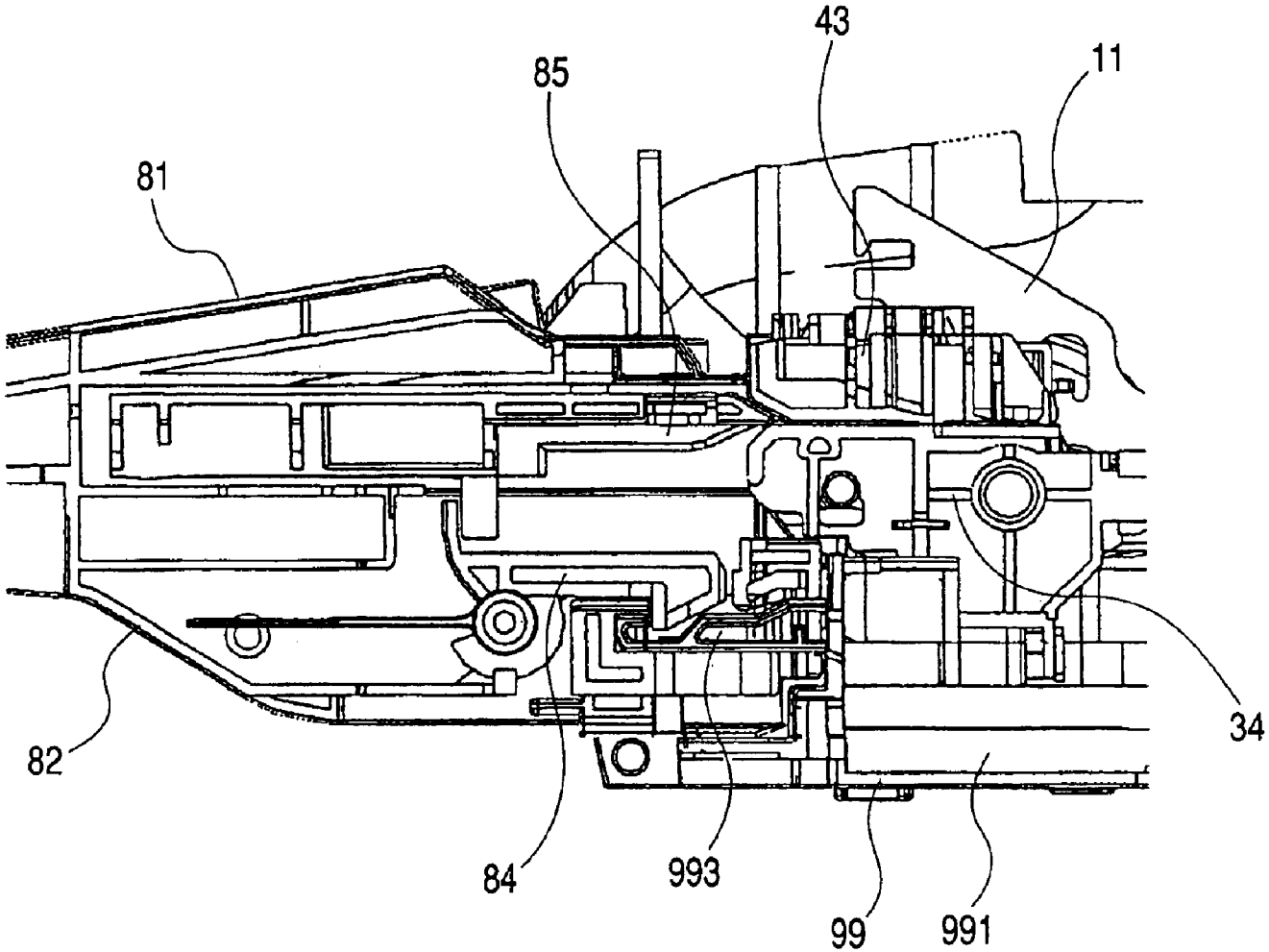
FIG. 9 is a partial, vertical cross-sectional view of the recording apparatus according to the first embodiment of the present invention wherein the hooks of the CD carrier unit engage the lower case.
Figure 10A:
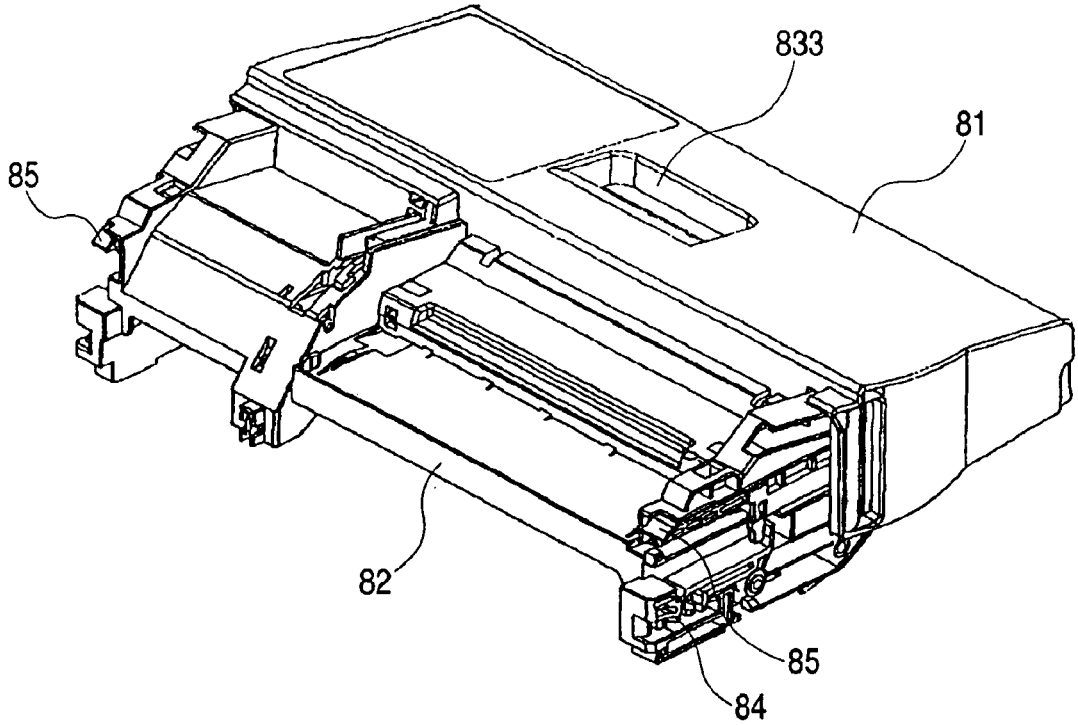
FIG. 10A is a perspective view of the CD carrier unit before the unit is attached to the recording apparatus according to the first embodiment of the present invention.
Figure 10B:
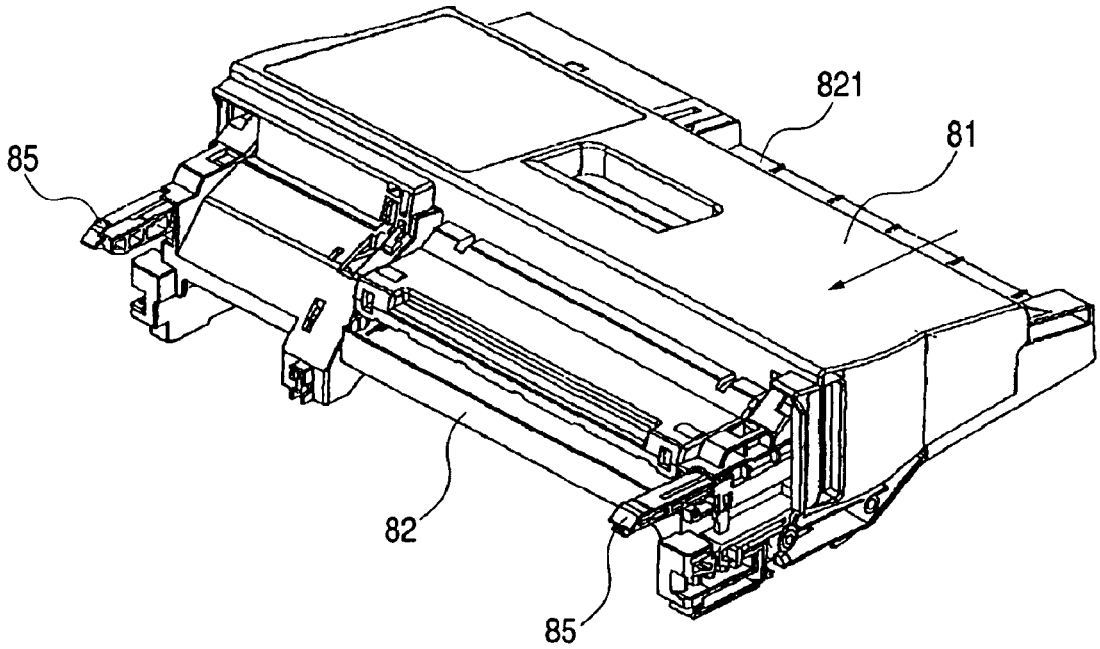
FIG. 10B is a perspective view of the state wherein, after the CD carrier unit has been attached, the slide cover is moved.
Figure 11:
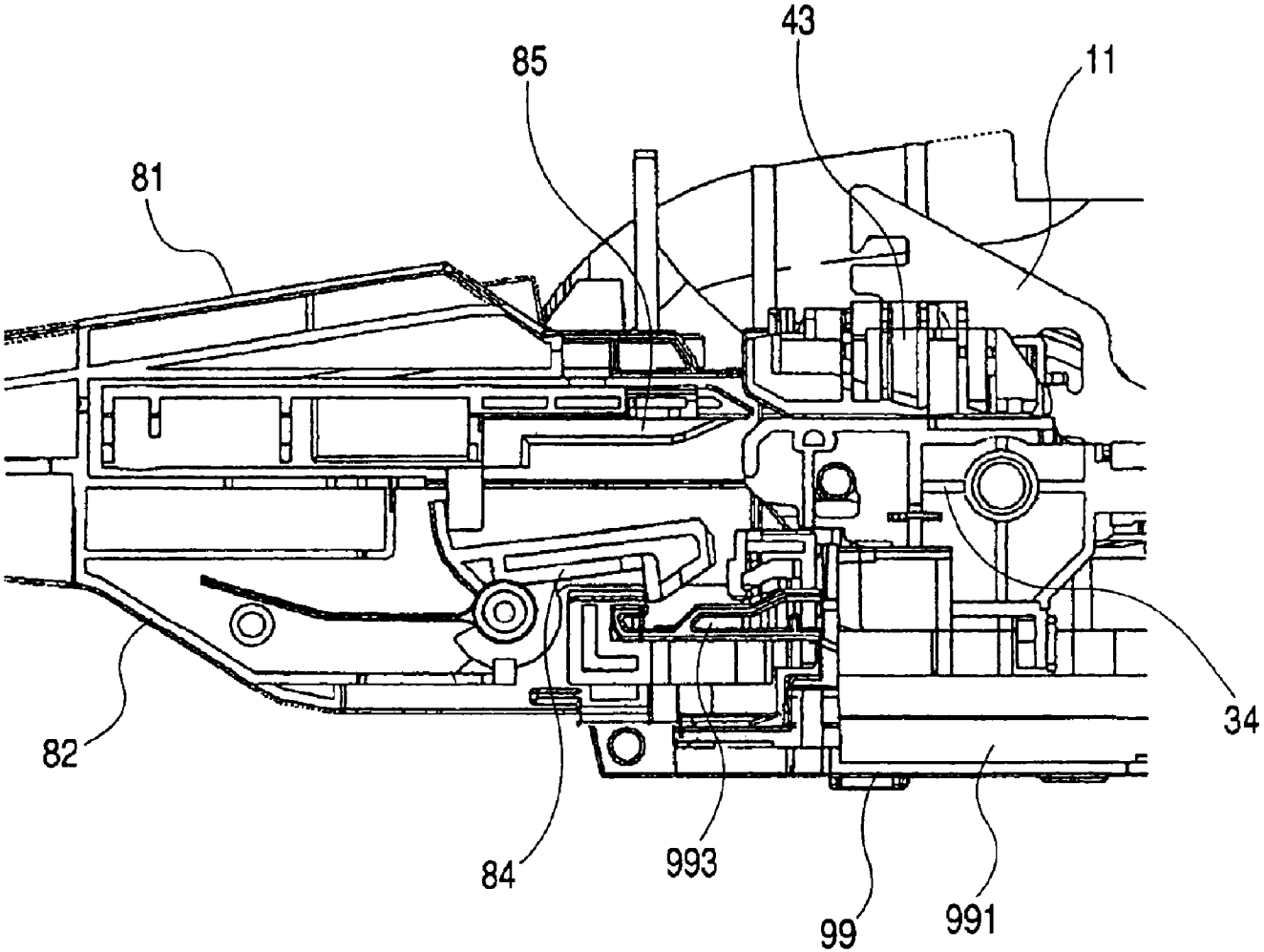
FIG. 11 is a partial, vertical cross-sectional view of the recording apparatus according to the first embodiment of the present invention wherein a hook of the CD carrier unit is disengaged from the lower case.
Figure 12A:
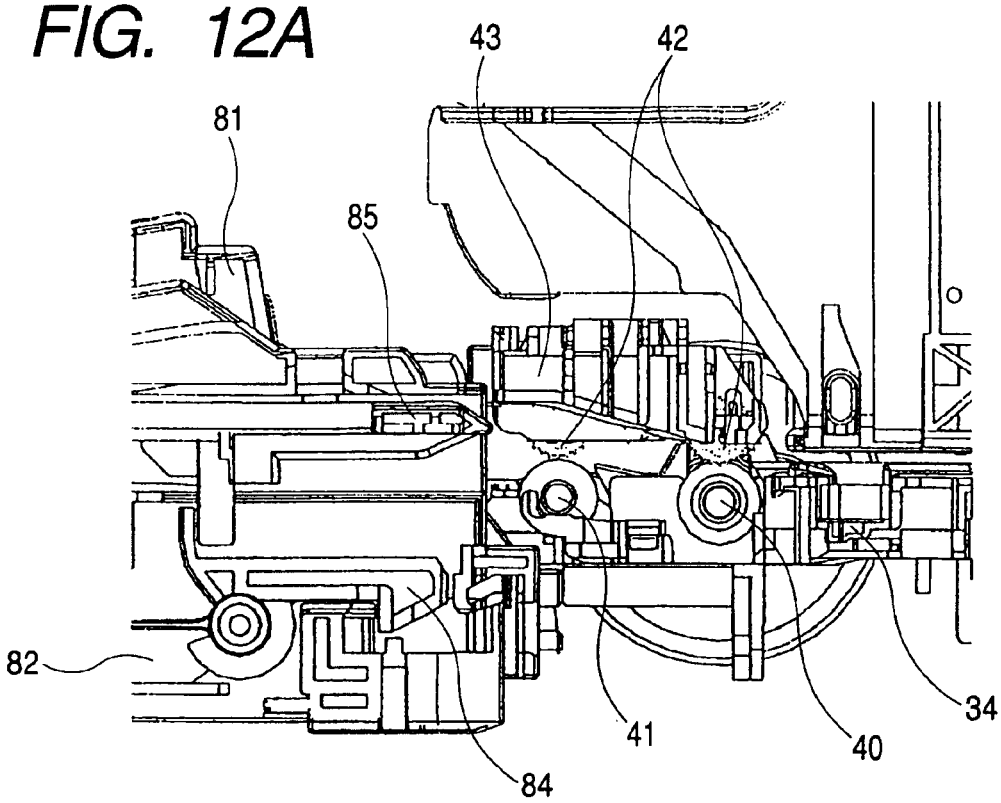
FIG. 12A is a partial, vertical cross-sectional view, for the recording apparatus according to the first embodiment of the present invention, of the state of an arm before the slide cover of the CD carrier unit is moved.
Figure 12B:
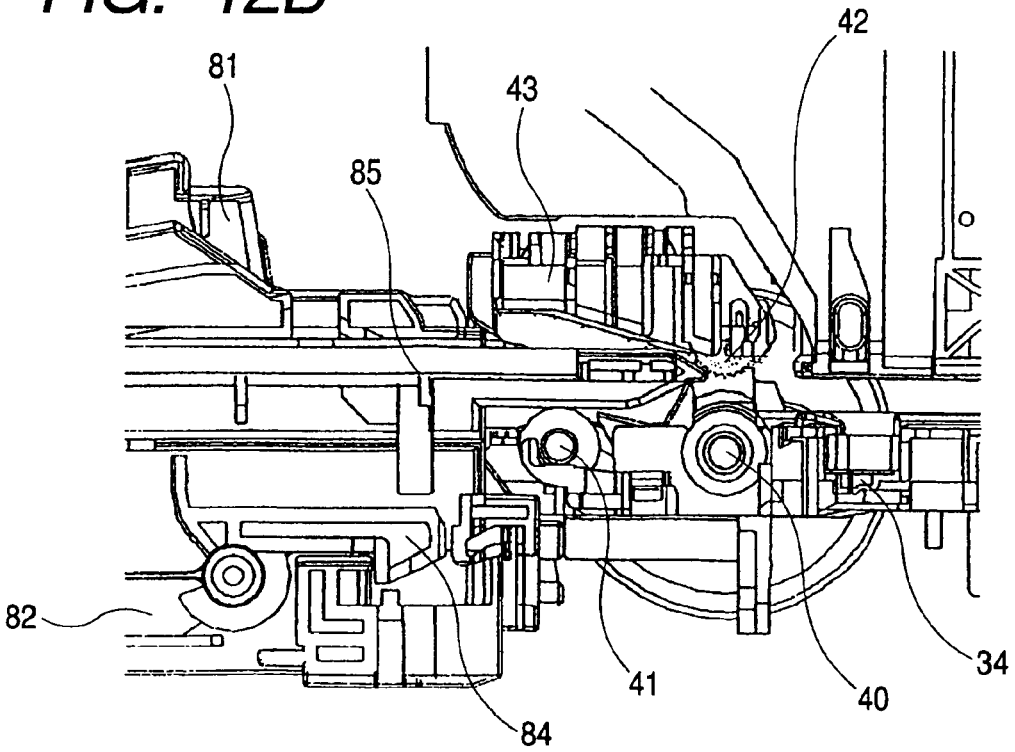
FIG. 12B is a partial, vertical cross-sectional view of the state of the arm before the slide cover of the CD carrier unit is moved.

While referring to FIGS. 6 to 19, a detailed explanation will now be given for the configuration of the recording apparatus 1 according to the embodiment, and for the CD printing operation using the CD carrier unit 8. FIGS. 6A and 6B are perspective views of the states of the recording apparatus 1 in FIG. 1 before and after the CD carrier unit 8 is attached thereto. FIG. 7 is a perspective view of the CD carrier unit 8 that can be attached to the recording apparatus 1 in FIG. 1. FIG. 8 is a partial perspective view of the portion of the lower case 99 whereat the CD carrier unit 8 is attached and the attachment is detected. FIG. 9 is a partial, vertical cross-sectional view of the state wherein hooks 84 of the CD carrier unit 8 engage the lower case 99. FIGS. 10A and 10B are perspective views of the state of a slide cover 81 before the CD carrier unit 8 is attached, and the state wherein the slide cover 81 is moved after the CD carrier unit 8 is attached. FIG. 11 is a partial, vertical cross-sectional view of the state wherein the hooks 84 of the CD carrier unit 8 are disengaged from the lower case 99. FIGS. 12A and 12B are partial, vertical cross-sectional views of the states of an arm 85 before and after the slide cover 81 of the CD carrier unit 8 has been moved.

Figure 13:
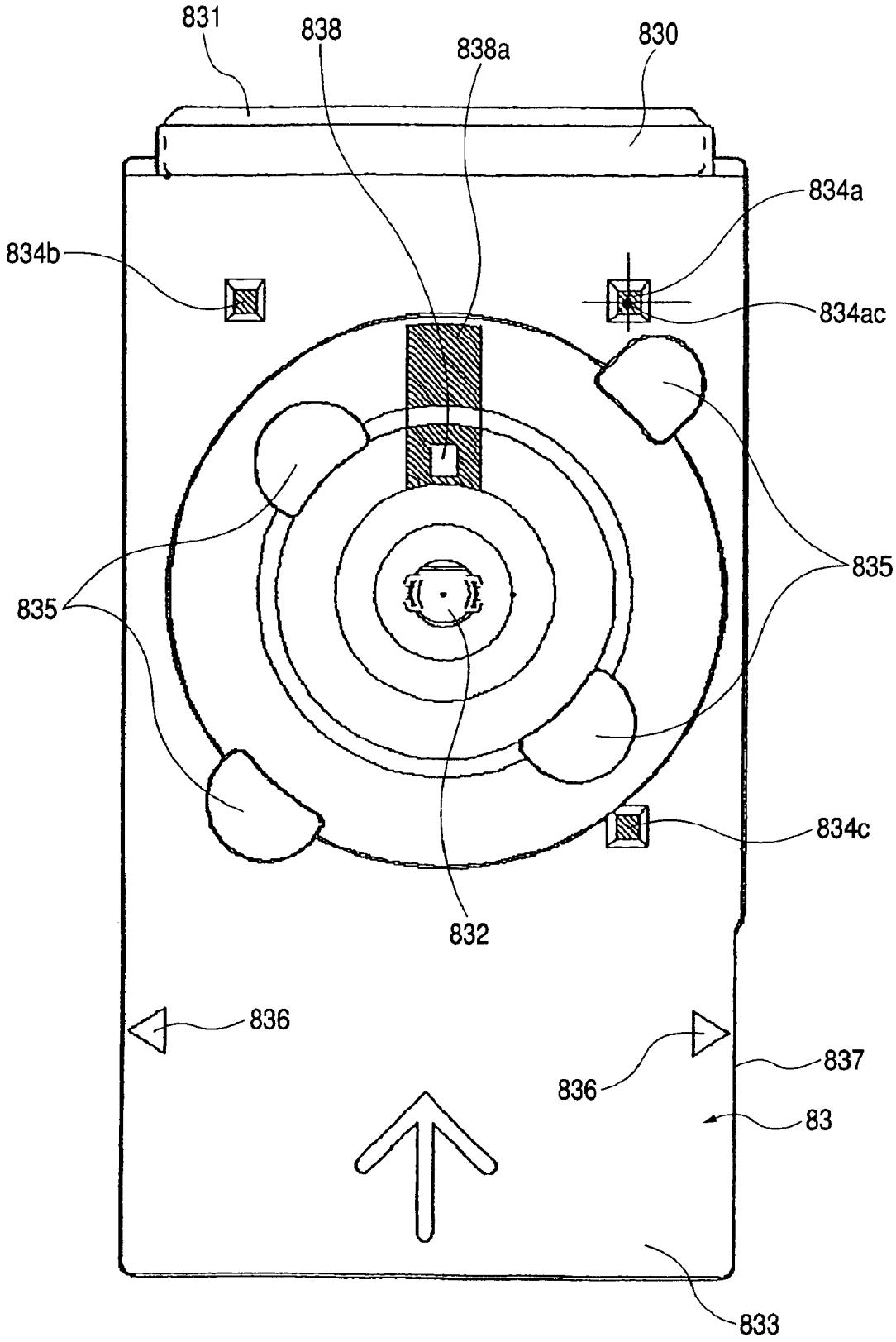
FIG. 13 is a plan view of the tray of the CD carrier unit for the recording apparatus according to the first embodiment of the present invention.
Figure 14:
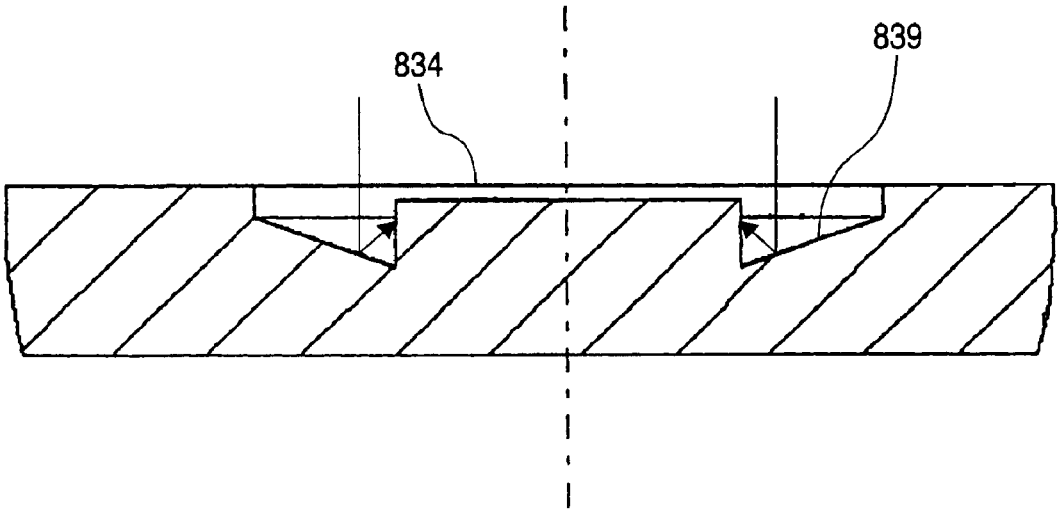
FIG. 14 is a specific cross-sectional view of the recessed portions for detecting the position of the tray in FIG. 13.
Figure 15:
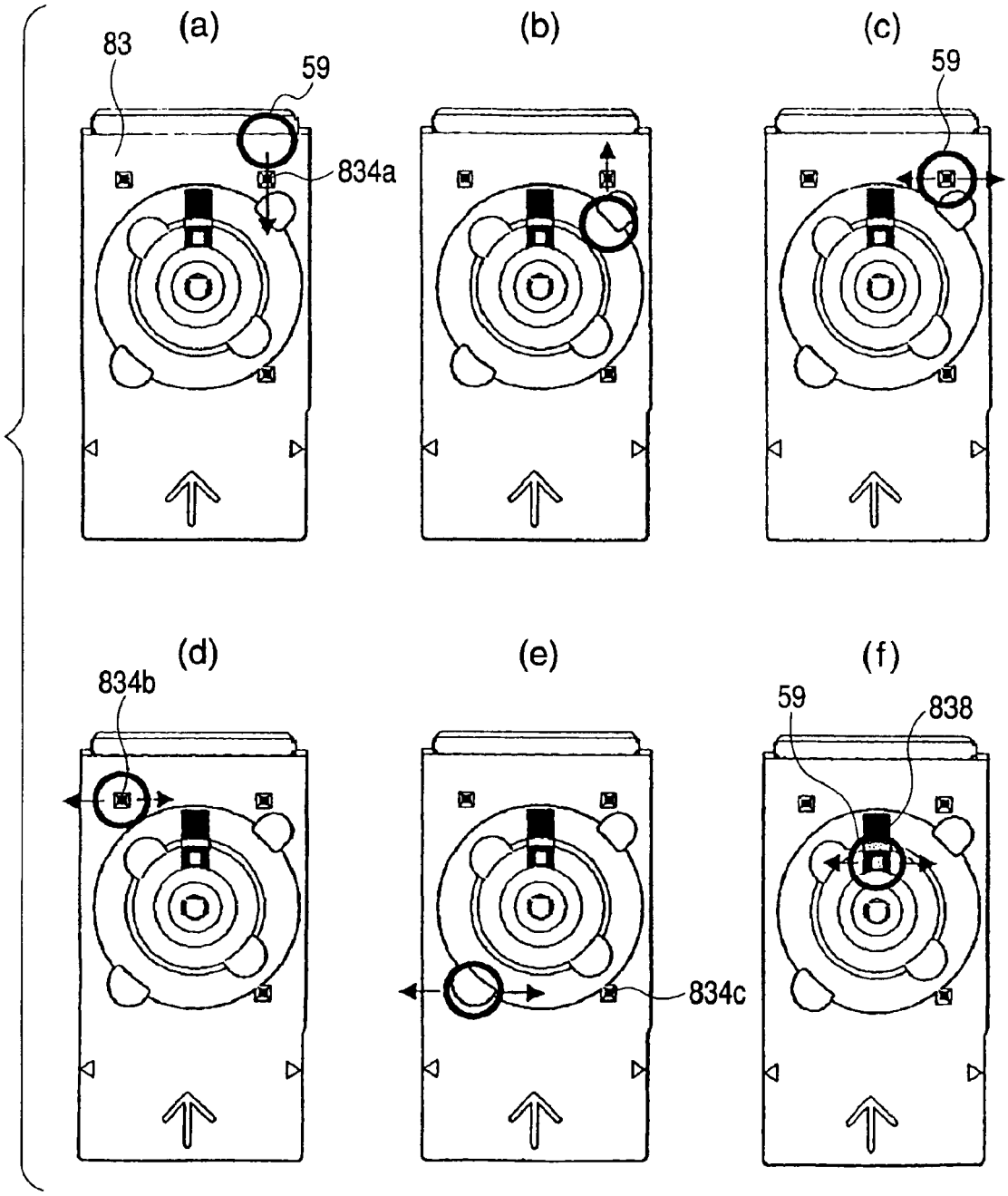
FIG. 15 is specific plan views of various positions occupied by the tray in FIG. 13 and a tray position detector.
Figure 16:
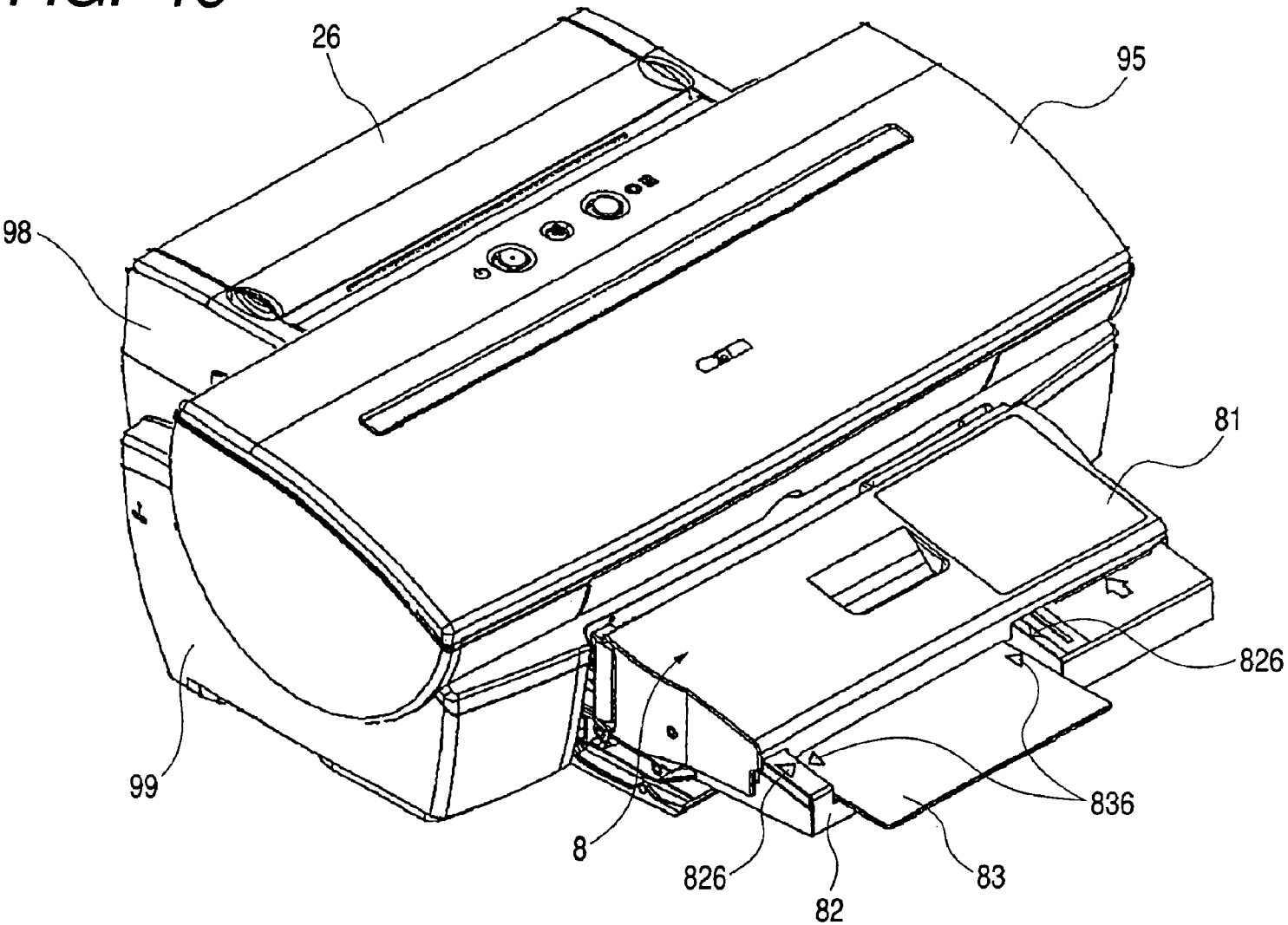
FIG. 16 is a perspective view of the state wherein the tray is inserted into and set up at the CD carrier unit attached to the recording apparatus according to the first embodiment of the present invention.
Figure 17:
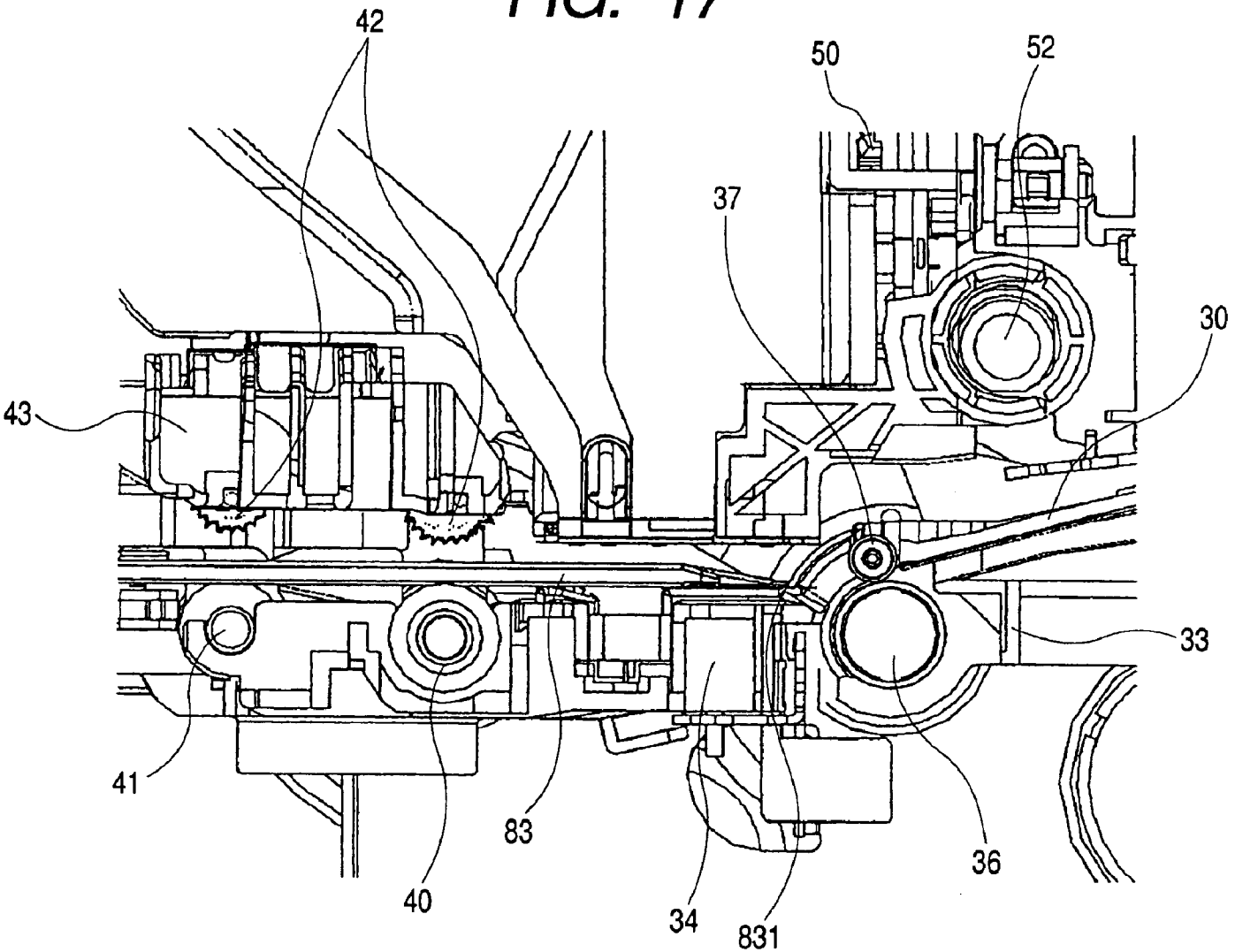
FIG. 17 is a partial, cross-sectional view of the state wherein the tray is conveyed inside the recording apparatus according to the first embodiment of the present invention.
Figure 18A:
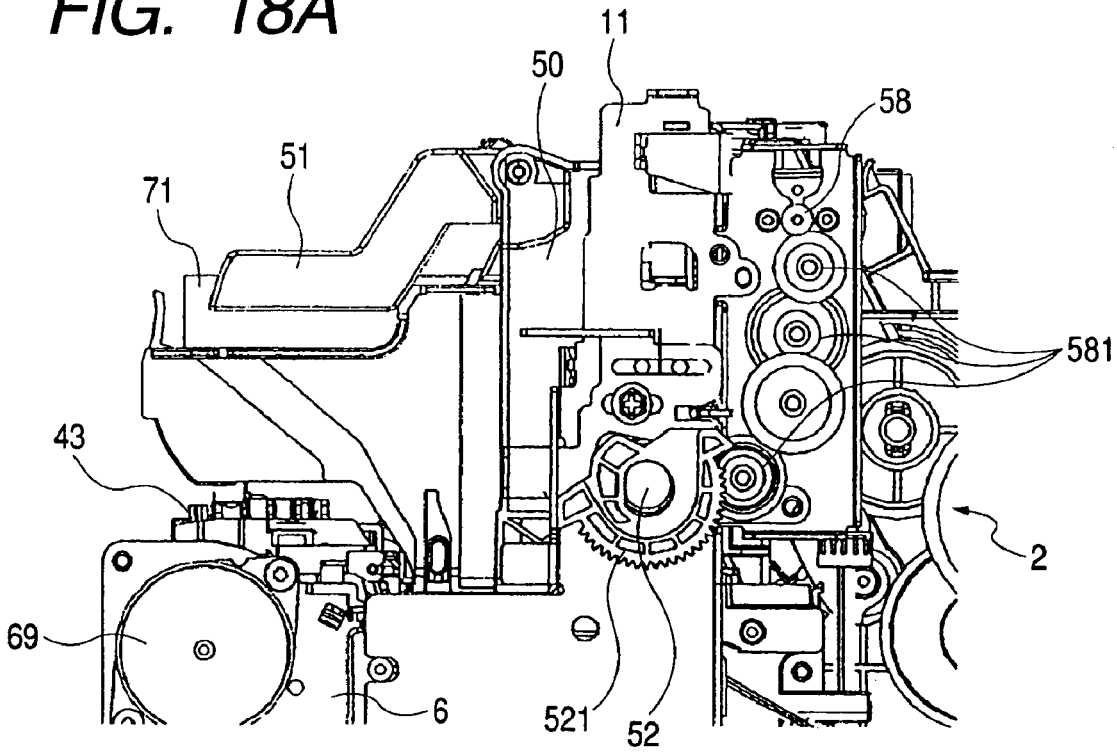
FIG. 18A is a partial, vertical cross-sectional view of the state, for the recording apparatus according to the first embodiment of the present invention, wherein a carriage is lowered by a shaft lifting mechanism for the ascent and descent of the guide shaft of the carriage.
Figure 18B:
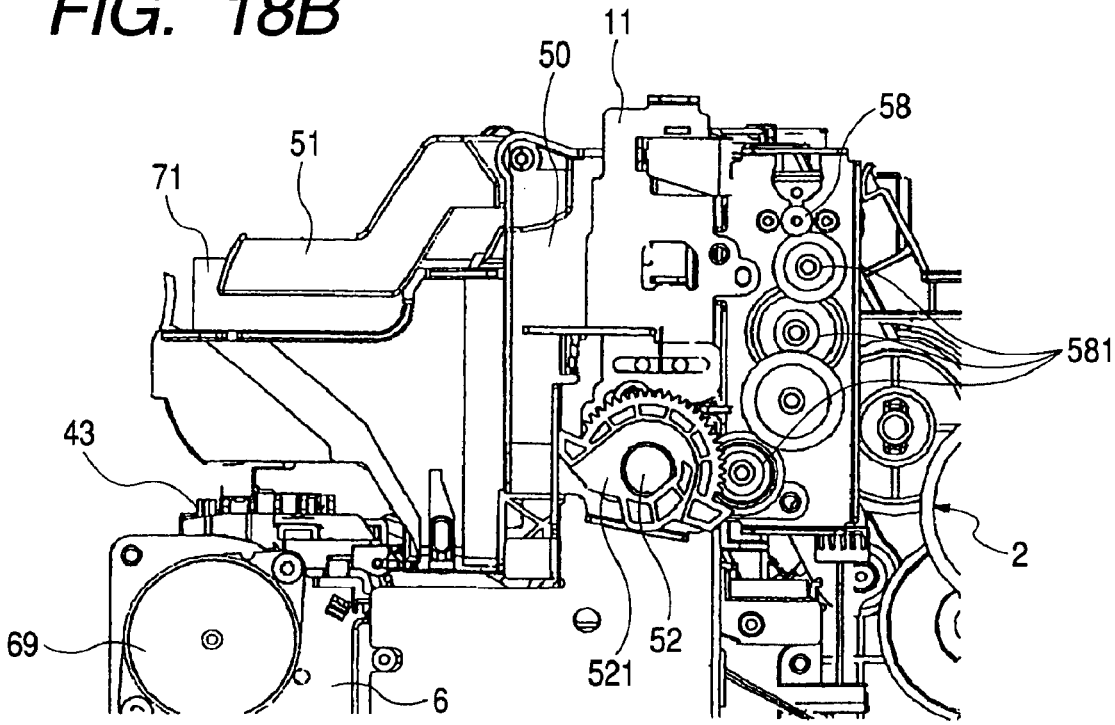
FIG. 18B is a partial, vertical cross-sectional view of the state wherein the carriage has been raised.
Figure 19:
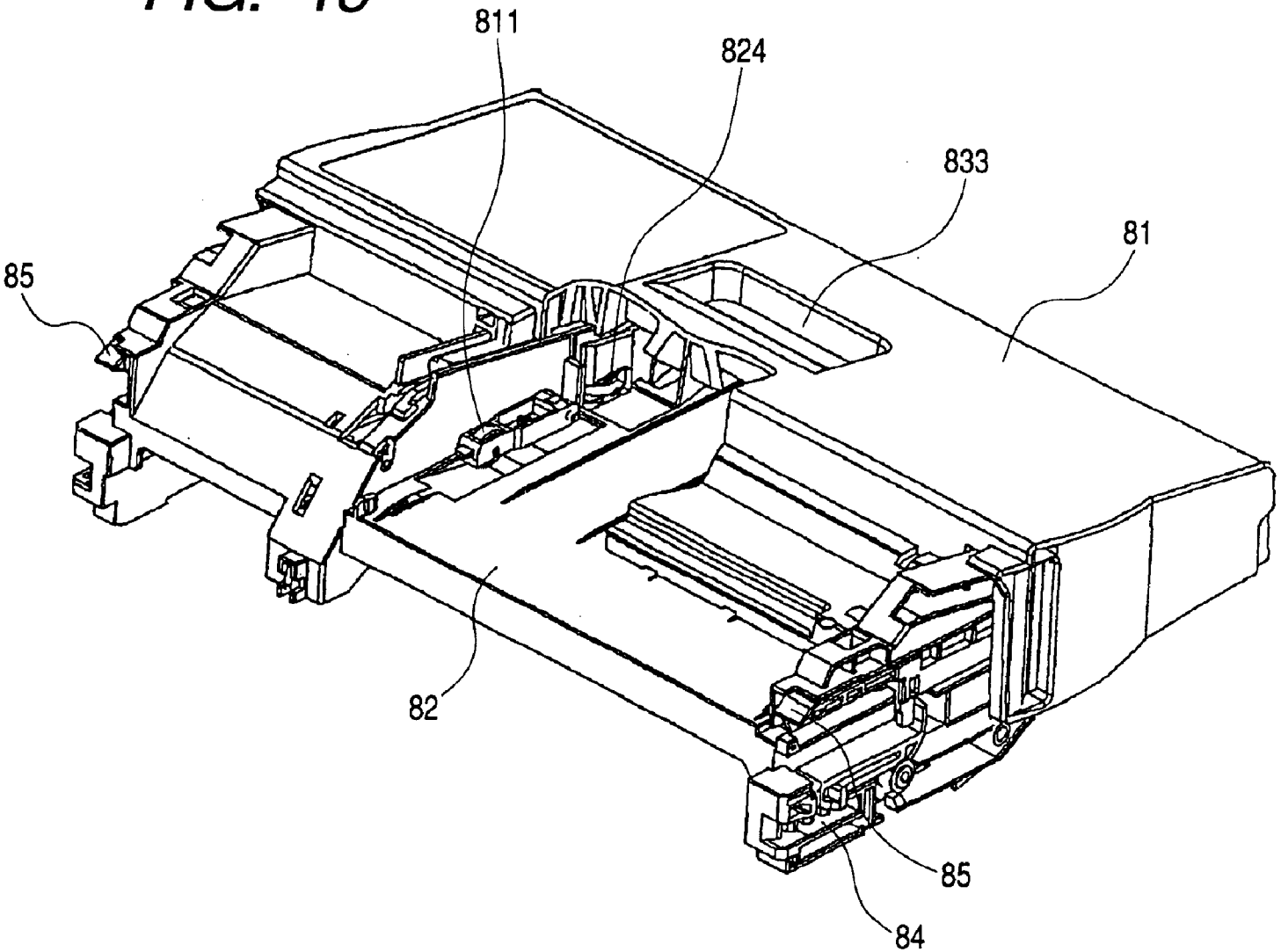
FIG. 19 is a partially exploded, perspective view of the CD carrier unit to be attached to the recording apparatus according to the first embodiment of the present invention, showing pressing rollers and a side pressing roller.

FIG. 13 is a plan view of the tray 83 of the CD carrier unit 8. FIG. 14 is a specific cross-sectional view of the recessed portions used to detect the position of the tray 83 in FIG. 13. FIG. 15 is specific plan views of various positional relationships between the tray 83 in FIG. 13 and a tray position detector 59. FIG. 16 is a perspective view of the state wherein the tray 83 has been inserted into and set in the CD carrier unit 8 attached to the recording apparatus 1. FIG. 17 is a partial, vertical cross-sectional view of the state wherein the tray 83 is conveyed inside the recording apparatus 1. FIGS. 18A and 18B are partial, vertical cross-sectional views of the states wherein the carriage 50 has been raised and lowered by the shaft lifting mechanism for raising and lowering the guide shaft 52 of the carriage 50. FIG. 19 is a partially exploded perspective view of the CD carrier unit 8 in which pressing rollers 811 and a side pressing roller 824 are shown.

As is shown in FIGS. 6A and 6B, when the CD carrier unit 8 is slid straight in, in the direction indicated by an arrow Y, the CD carrier unit 8 is attached to the lower case 99 of the recording apparatus 1. At this time, since engagement portions 822, located on both sides of a tray guide 82 are inserted along guide rails 993, provided on both sides of the lower case 99 shown in FIGS. 8 and 9, the CD carrier unit 8 is positioned. The pivotable hooks 84 are provided at both right and left ends of the tray guide 82, and are forced in one direction. When the CD carrier unit 8 is slid in and inserted into a predetermined position, the CD carrier unit 8 abuts upon a specific portion, and can not be inserted further. Then, the hooks 84 engage the stoppers of the guide rails 993, so that the CD carrier unit 8 is locked in and can not be returned in the direction in which it was inserted. A tray guide detector 344 is provided for the platen 34 to mechanically detect the state wherein the tray guide 82 is attached to the recording apparatus 1 at a predetermined position. When the tray guide 82 is attached to the main body of the recording apparatus 1, one part of the tray guide 82 pushes against the tray guide detector 344, which can thus detect the attachment of the CD carrier unit 8 (tray guide 82).

Following this, as is shown in FIGS. 10 and 12, when the slide cover 81 is moved toward the main body of the recording apparatus 1 (nearer the main body), the arm 85 is interlocked with the slide cover 81 and is projected toward the main body. Since the spur holder 43, wherein the spurs 42 are mounted, is so attached to the platen that it may move vertically, and is forced down by a spring applied predetermined pressure, when the arm 85 is inserted between the spur holder 43 and the platen 34, the spur holder 43 is pushed upward a predetermined distance. At this time, an inclined portion 851, formed on the distal end of the arm 85, can be employed to smoothly insert the arm 85 between the platen 34 and the spur holder 43. As a result, between the platen 34 and the spur holder 43, a space can be defined through which the tray 83, on which a CD (e.g., a CD-R), a recording medium, is mounted, can be passed.

Furthermore, the arm 85 is positioned while being inserted between the platen 34 and the spur holder 43, and before the arm 85 is projected (moved forward), i.e., when it is stored in the tray guide 82, it is held so there is some play relative to the tray guide 82. Further, since an opening 821 of the CD carrier unit 8 is closed under a condition wherein the slide cover 81 is not moved toward the main body of the recording apparatus 1, the insertion of the tray 83 is prohibited. According to the configuration, since toward the main body of the recording apparatus 1 the slide cover 81 is moved obliquely upward, between the slide cover 81 and the tray guide 82 the tray insertion opening 821 can be obtained. Under this condition, as is shown in FIG. 16, the tray 83, in which a CD has been loaded, can be inserted through the opening 821 and set at a predetermined position. With this configuration, when the tray 83 is inserted in the condition wherein ascent of the spur holder 43 has not occurred, interference by the tray 83 with the spurs 42 can be prevented, and a tray sheet 831, at the distal end of the tray 83, and the spurs 42 can be protected and prevented from being damaged.

As is shown in FIG. 11, when the slide cover 81 is pulled from the main body while the tray guide 82 is attached, the arm 85 interlocks with the slide cover 81 and is removed from the spur holder 43, and the spur holder 43 and the spurs 42 descend to their original, predetermined positions. At this time, while the tray 83 is still attached, the tray 83 is caught at the opening 821 defined between the slide cover 81 and the tray guide 82, and the slide cover 81 is prevented from being pulled farther. Therefore, this configuration prevents a defective operation during which the spurs 42 descend and damage a recording medium, such as a CD or a CD-R, while the recording medium is in the recording apparatus 1. When the slide cover 81 is pulled farther forward, as is shown in FIG. 11, the slide cover 81 displaces the hooks 84, which are thus disengaged from the guide rails 993 in the lower case 99. As a result, the CD carrier unit 8 is released from the main body of the recording apparatus 1.

The tray 83 for this embodiment is a resin plate 2 to 3 mm thick, and as is shown in FIG. 13, on the tray 83 are provided a CD attachment portion 832, an operating portion 833, which an operator grasps when inserting and removing the tray 83, position detection marks 834 (three marks 834*a*, 834*b* and 834*c* in FIG. 13), CD removal holes 835, insertion position alignment holes 836, a side pressing roller flank 837, a media detection mark 838, and a tray adaptor type detection mark 838*a* used to identify a tray adaptor type. Further, at the distal end of the tray 83, the tray sheet 831 is provided to ensure that the conveying roller 36 and the pinch rollers 37 sandwich the tray 83.

The position detection marks 834 are arranged at two positions (834*a* and 834*b*), nearer the distal end of the tray 83, away from the CD attachment portion, and at one position (834*c*) in the opposite direction. A 3 to 10 mm square of highly reflective material is employed to form the position detection marks 834, and in this embodiment, hot stamps are employed to apply the material. Around the position detection marks 834, as is shown in FIGS. 13 and 14, recessed portions 839 are described so that the reflected light will be shaped like the position detection marks 834 of the resin part. As is also shown in FIG. 14, since surface finishing is used to prepare the bottoms of the recessed portions 839 and provide surfaces that are set at a predetermined angle, when the light emitted by the tray position detector 59 provided for the carriage 50 is reflected by a portion other than a position detection mark 834, the reflected light is inhibited from returning to the light receiving portion. With this configuration, the detection of an erroneous tray 83 position can be prevented.

As is described above, since the reflectivity for the position detection marks 834 on the tray 83 is high, a high-performance sensor need not be mounted, the need for a compensation process can be reduced, and an increase in the manufacturing costs and the recording time period (the printing time) can be avoided. In addition, compared with a system for directly reading the edge of the printing area (recording area) of a CD, an accurate position can be detected for the CD even when printing is performed on a colored CD, or when re-printing is performed for a CD that has been printed once.

A plurality of mold pawls are provided for the CD attachment portion 832, and are used for positioning and for removing play when the CD is attached. To attach a CD, the operator need only align the hole in the center of the CD with the CD attachment portion 832; and to remove the CD, the operator can employ the two CD removal holes 835 to hold the outer edge of the CD. Further, the CD attachment portion 832 is positioned lower than the other portions of the tray 83, and a media detection mark 838 is provided for the lower face. This media detection mark 838 is a hole having a predetermined width that is formed by a hot stamp which also has a predetermined width, and when the width of this hole is detected, it is ascertained that no medium has been loaded.

As is shown in FIG. 13, the tray sheet 831 is attached to the distal end of the tray 83 in order to ensure the tray 83 can be inserted between the conveying roller 36 and the pinch rollers 37. The tray sheet 831 is formed of a sheet material, such as PET, having a thickness of about 0.1 to 0.3 mm and a predetermined friction coefficient and a predetermined hardness. Further, a tapered portion 830 is arranged at the distal end of the tray 83 itself. With this configuration, first, when the tray sheet 831 is inserted between the conveying roller 36 and the pinch rollers 37, the conveying force is generated, and then, when the tapered portion 830 at the distal end of the tray 83 raises the pinch rollers 37, and the thick tray 83 is sandwiched by the convey roller 36 and the pinch rollers 37, the tray 83 can be accurately conveyed. Since the position detection marks 834 are located between the pinch rollers 37, the position detection marks 834 will not contact the pinch rollers 37, so that the scratching of the surfaces of the position detection marks 834 can be prevented.

In FIG. 19, the side pressing roller 824 is provided for the tray guide 82 constituting the CD carrier unit 8 in order to press the tray 83, in FIG. 13, against a reference 823 on the tray guide 82. For the positioning of the tray 83, a roller spring 825 is employed to provide a predetermined pressure for pressing the tray 83 against the reference 823. The side pressing roller 824 acts on the tray 83 until the operator has set the tray 83 in a predetermined position, and thereafter, when the tray 83 begins to be conveyed by the conveying roller 36 and the pinch rollers 37 and the side pressing roller 837 (FIG. 13) reaches the position where the side pressing roller 824 is acting, the action of the side pressing roller 824 on the tray 83 is halted. According to this configuration, unnecessary back tension does not act on the tray 83, and a reduction in the accuracy with which the tray 83 is conveyed can be prevented.

As is shown in FIG. 19, the right and left pressing rollers 811 are provided for the slide cover 81, and when a predetermined pressure is applied by a roller spring 812 to press the tray 83 against the sheet discharge roller 41, the force for conveying the tray 83 is generated. By employing this conveying force after the recording (printing) has been started, the tray 83 can be conveyed from the set position to the position of the nip formed by the convey roller 36 and the pinch rollers 37, and when the recording (printing) is terminated, the tray 83 can be conveyed to a predetermined position whereat it is removed by the operator. In this case, the position detection marks 834 and the side pressing rollers 811 are located at different positions, so that the surfaces of the position detection marks 834 are protected from being scratched by contacting the side pressing rollers 811. When the tray 83 has reached the predetermined position, the operator can pull the tray 83 and remove it from the tray guide 82, and can hold the outer edge of the CD, using the two CD removal holes 835, and extract the CD.

Figure 20:
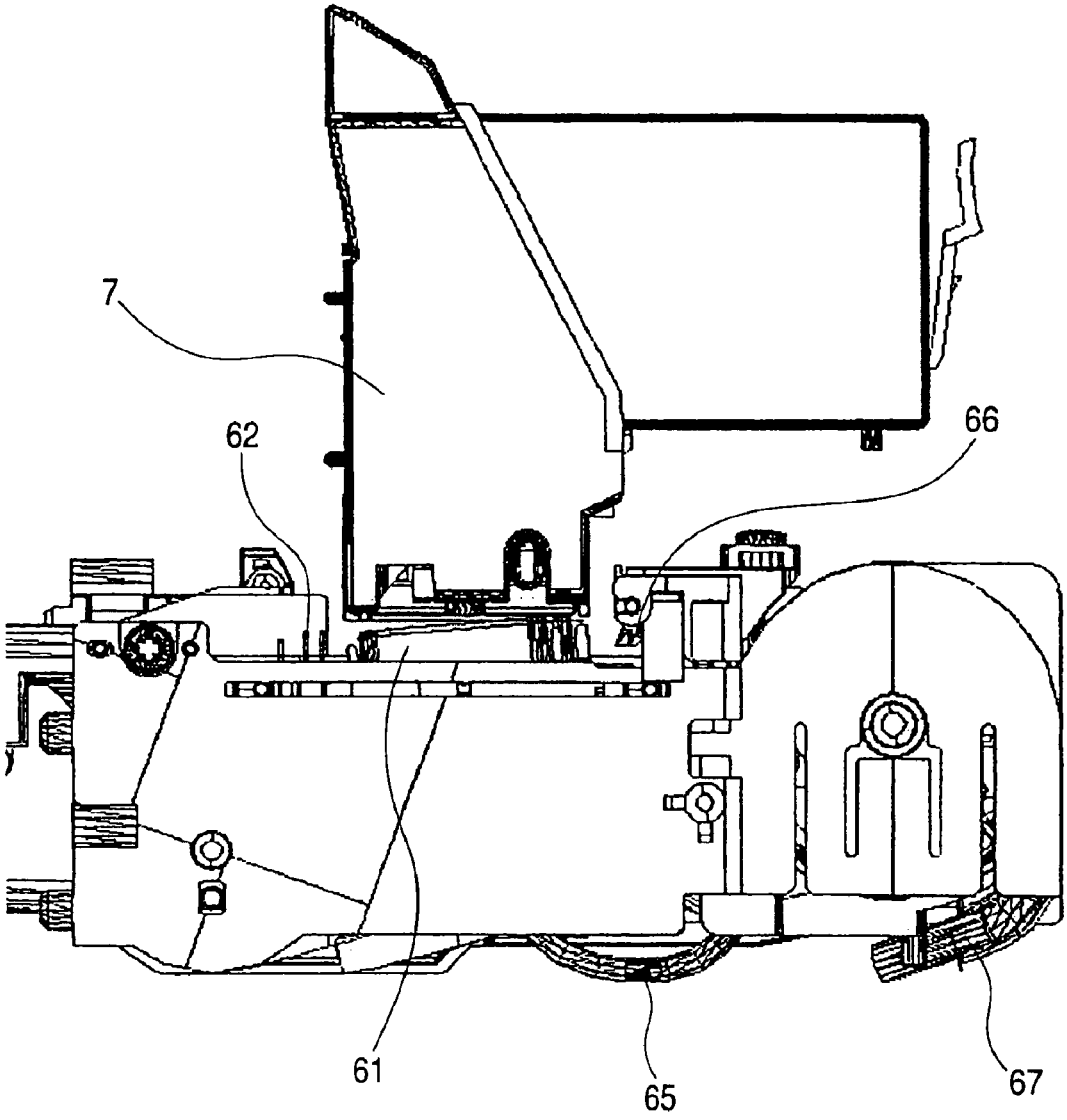
FIG. 20 is a specific side view of the state for a conventional recording apparatus wherein a recording unit is raised to a CD printing height position (a CD recording position)

An explanation will now be given for the operation of the thus arranged recording apparatus for recording (printing) data on a CD. FIG. 20 is a specific side view of a conventional recording apparatus wherein a recording head (recording unit) 7 ascends to a CD printing height position (CD recording position). FIG. 21 is a flowchart showing the processing performed by the recording apparatus 1 according to the first embodiment for raising or lowering the carriage (recording unit) 50. First, the CD carrier unit 8 is slid straight toward the main body of the recording apparatus 1 and is attached to the lower case 99. At this time, the tray guide detector 344 (FIG. 8) determines that the tray guide 82 has been loaded into the main body. Then, when the slide cover 81 is moved toward the main body of the recording apparatus 1, as is shown in FIG. 10, the arm 85 interlocks with the slide cover 81 and projects toward the main body. Following this, the arm 85 is inserted between the spur holder 43 and the platen 34, and raises the spur holder 43 to a predetermined height.

As is described above, since the slide cover 81 is moved obliquely upward as it is shifted toward the main body of the recording apparatus 1, the opening 821 (FIG. 6) is defined between the slide cover 81 and the tray guide 82. In this state, as is shown in FIG. 16, the tray 83 on which the CD has been mounted can be inserted through the opening 821, and be set at a predetermined position. Thus, the operator loads the CD into the CD attachment portion 832 (FIG. 13) of the tray 83, and inserts the tray 83 by holding the operating portion 833 (FIG. 13) until the insertion position alignment marks 836 (FIGS. 13 and 16) are aligned with tray set mark 826 (FIG. 16).

When in this state a recording signal (a printing signal or an image signal) is received from a host computer, the recording operation (printing operation) is initiated. First, as is shown in FIG. 17, the conveying roller 36 and the sheet discharge rollers 40 and 41 are reversely rotated. That is, in FIG. 17, since the force for conveying the tray 83 is generated when the pressing rollers 811 (FIG. 19) and the roller spring 812 push the tray 83 against the sheet discharge rollers 40 and 41, the tray 83 is conveyed inside the recording apparatus 1 in accordance with the reverse rotation of the sheet discharge rollers 40 and 41. Then, a predetermined conveying force is generated by the insertion of the tray sheet 831 (FIG. 13) between the conveying roller 36 and the pinch rollers 37, and the tray 83 is sandwiched by the conveying roller 36 and the pinch rollers 37 when the pinch rollers 37 are raised by the taper portion 830 at the distal end of the tray 83.

Following this, the carriage 50 on which the recording head 7 is mounted is moved from the home position to the recording area (printing area) to detect the tray 83. At this time, as is shown in FIGS. 18A and 18B, since the carriage lifting motor 58 (FIG. 3) raises the guide shaft 52, the optimal gap (inter-sheet distance) can be obtained between the recording head 7 and the tray 83. Then, as is shown in (a) and (b) in FIG. 15, the carriage 50 is halted when the tray position detector 59 of the carriage 50 is aligned with the position detection mark 834*a* (FIG. 13) on the tray 83. Thereafter, the tray 83 is conveyed and the edge position of the upper end (distal end) of the position detection mark 834*a* is detected. The tray 83 is sequentially conveyed and the lower end edge (rear end edge) of the position detection mark 834*a* is detected.

Next, as is shown in (c) in FIG. 15, the tray 83 is returned so that the tray position detector 59 of the carriage 50 is positioned substantially in the center of the position detection mark 834*a*. Then, the carriage 50 is moved horizontally, and the positions of the right end edge and the left end edge of the position detection mark 834*a* are detected. Through this processing, a center position 834*ac* (FIG. 13) for the position detection mark 834*a* can be obtained, and with the center position 834*ac*, the accurate recording position (printing position) of the CD mounted on the tray 83 can be acquired. As is described above, according to this embodiment, since the position of the tray 83 has been detected, compared with the system where printing is performed without the position detection and based only on the mechanical accuracy, the shifting of the recording position (printing position) on the CD can be prevented that is due to the manufacturing variance of parts or the state of the tray.

After the position (the center position 834*ac*) of the position detection mark 834 on the tray 83 has been detected, as is shown in (d) in FIG. 15, the carriage 50 is moved to detect the position detection mark 834*b*. When both end edges of the position detection mark 834*b* have been detected, it is confirmed that the previously detected position of the position detection mark 834*a* was correct. This operation is performed for the following reason. When the tray 83 is set to the rear of the regular set position, and when the location of the position detection mark 834*c* is detected as is shown in (e) in FIG. 15, it can be ascertained, as the carriage 50 is moved to detect the position detection mark 834*b*, that this position is not the position detection mark 834*a*.

After the position of the tray 83 has been obtained, as is shown in (f) in FIG. 15, the tray 83 is conveyed in the conveying direction, so that the position of the tray position detector 59 of the carriage 50 matches the position of the media detection mark 838 (FIG. 13) of the tray 83. At this time, when the edge of the detection hole of the media detection mark 838 is detected and the width of the hole matches a predetermined hole width, it is ascertained that a CD is not mounted, the recording operation (printing operation) is halted, the tray 83 is returned to a predetermined position, and an error message is displayed. When the media detection mark 838 is not detected, it is ascertained that a CD is mounted, and the recording operation is continued.

When the above described series of initial processes has been completed, the tray 83 is conveyed rearward in the recording apparatus (e.g., printer) 1 to a predetermined position where recording (printing) can be performed across the whole CD. Thereafter, recording (printing) is initiated in accordance with image data received from the host computer. For recording images, a so-called multi-path recording method for forming an image using multiple scanning is employed to reduce uneven bands for recorded images that occur, depending on the conveying accuracy for the CD and the accuracy with which ink is deposited by the recording head 7.

After the recording (printing) has been completed, the tray 83 is conveyed to the position whereat, before the printing, it was set by the operator in the tray guide 82. In this state, the operator can extract the tray 83 on which the printed CD is mounted. When a succeeding CD is to be sequentially printed, another CD need only be set on the tray 83 and a printing instruction executed. However, when the printing is to be terminated, the recording head 7 is capped after a predetermined period of time has elapsed. At this time, merely by moving the carriage unit 5 (carriage 50) to the position of the cap 61, the recording head 7 can not be satisfactorily capped. That is, since the carriage unit 5 ascended to the CD printing position, the cap 61 and the blade 62 can not track the carriage unit 5. Therefore, as in FIG. 20, which shows the state of a conventional recording apparatus when the recording head 7 has ascended to the CD printing height position, the cap 61 can not seal the orifice face of the recording head 7, and the blade 62 misses the orifice face of the recording head 7 and can not satisfactorily perform cleaning (wiping).

As is described above, FIG. 21 is a flowchart showing the operation of the carriage lifting mechanism for the ascent and descent of the carriage (recording unit) 50 of the recording apparatus 1 according to the first embodiment of the present invention. To resolve the above described shortcoming, the control process sequence shown in FIG. 21 is performed for the first embodiment. In FIG. 21, at step S1, the tray guide 82 (CD carrier unit 8) is attached to the main body of the recording apparatus 1, and the tray 83, on which a CD is mounted, is set (FIG. 16). At step S2, the recording operation series is initiated upon the reception of a recording instruction (printing instruction) from a host computer (not shown), and at step S3, the tray guide detector 344 (FIG. 8) detects the presence/absence of the tray guide 82. When it is ascertained that the tray guide 82 is not loaded, an error message is displayed.

When it is ascertained that the tray guide 82 is loaded, at step S4 the cap 61 is released from the orifice face of the recording head 7 to open the orifices. At step S5, the carriage lifting motor 58 raises, to a predetermined position, the carriage unit 5 (carriage 50) on which the recording head 7 is mounted. Then, at step S6, the carriage unit 5 performs scanning to initiate the recording operation. At this time, the recording head 7 prints (records) data on the CD without interfering with the tray 83. When the printing across the whole face of the CD has been completed, the tray 83, with the mounted CD, is discharged.

When, at step S7, the printing of another CD is required, a new CD is set on the tray 83 and the printing operation (recording operation) is started upon the reception of a printing instruction. When the printing of all the CDs has been completed, program control advances to step S8 after a predetermined period of time has elapsed, and the carriage unit 5 is returned to the normal printing height position (initial height position). Program control then advances to step S9, and at the normal printing height, the cap 61 is brought in close contact with the orifice face of the recording head 7 to obtain the cap closing (capping) state. According to the above described CD printing operation, not only is the capping ensured before and after the recording operation using the carriage scanning is performed, but also before and after the wiping or the ink absorption is performed, the recording head is always located at the normal printing height position (the initial height position or the lowest position in this embodiment). Therefore, the various cleaning processes (recovery processes), including the capping and the wiping operations, can be stably performed.

Furthermore, the operator does not have to manipulate a lever, and need only set the CD on the tray guide 82 and wait for the printing instruction from the host computer, for the printing height position of the recording head 7 to be automatically changed. Therefore, there is no need for the operator to remember to perform the operation for changing the printing height. In addition, since the troublesome lever manipulation is not required, the usability of the recording apparatus can be improved. According to the configuration and the operation explained while referring to FIG. 21, not only can the CD printing be easily performed, but also it is ensured that an operation (recovery operation) such as the capping operation or the wiping operation will be performed by the cleaning unit (recovery unit). As a result, the satisfactory performance of the recording function by the recording unit 7 can always be provided.

(Second Embodiment)

FIG. 22 is a flowchart for the operation, for a recording apparatus according to a second embodiment of the present invention, of a carriage lifting unit for the ascent and descent of a carriage on which a recording unit is mounted. In the second embodiment in FIG. 22, a carriage lifting mechanism (carriage lifting unit) is driven by a carriage lifting motor 58, and can change the position of a recording head 7 (carriage unit 5) by progressively setting it at three positions: the normal printing height position (normal printing position), the thick sheet printing height position (thick sheet printing position) and the CD printing height position (CD printing position). Since the recording operation performed at the CD printing position is the same as that for the first embodiment (FIG. 21), no further explanation for it will be given, and for the second embodiment, only the printing operation (recording operation) performed at the thick sheet printing position will be described while referring to FIG. 22.

In FIG. 22, first, at step S1 a host computer selects a thick sheet (or paperboard), such as an envelope, and issues a recording instruction (printing instruction). Upon the reception of the thick sheet recording instruction, at step S2, a cap 61 is released (opened) from the recording head 7, and at step S3, the carriage unit 5 ascends to the thick sheet printing position. Since, in this state, the recording head 7 is set so that it does not interfere with the envelope, the conditions under which the printing operation (recording operation) at step S4 is performed are preferable and appropriate.

At step S5, a check is performed to determine whether a succeeding page is to be printed. When there is a succeeding page to be printed, the printing operation (recording operation) is performed for the pertinent page. When all the recording operation has been completed, at step S6, the carriage unit 5 is moved to a position facing the cap 61, to which it descends. When, at the capping enabled position, the carriage unit 5 is returned to the normal printing position (the initial height position or the lowest position in this embodiment), at step S7, under appropriate conditions, the recording head 7 is wiped by a blade 62 and is securely closed by the cap 61. Thereafter, the recording process sequence (printing sequence) is terminated.

Since a detection unit, such as the tray guide detection sensor 344 (FIG. 8), is not provided for the printing of the thick sheet in the second embodiment, a sheet type designation signal received from the host computer is employed as a carriage separation instruction. Further, also for the second embodiment when a thick sheet is employed, the recording head 7 is always located at the normal printing position during the capping operation or the wiping operation performed before or after the recording operation using the carriage scanning. Therefore, a stable cleaning operation, such as the capping operation or the wiping operation, can be performed. Furthermore, the operator need not change the position of a lever, and since the printing position of the recording head 7 is automatically changed upon the reception of a thick sheet printing instruction from the host computer, the operator need not remember to perform a position changing operation. In addition, since the troublesome lever operation is not required, the usability of the recording apparatus can be improved.

Further, referring to FIG. 22, in the second embodiment the same operation as in the first embodiment (FIG. 21) is performed for the CD printing. As is described above, according to the recording apparatus of the first and the second embodiments, wherein a plurality of height positions are provided for the recording head 7, and wherein the printing height position of the recording head 7 is automatically changed in accordance with a separation instruction (a recording head ascent instruction), the position of the recording head 7 is returned to a predetermined position (the normal position or the initial position in the embodiments) before the cleaning operation (recovery operation) is initiated. Therefore, the recording apparatus provides superior usability, performs an accurate cleaning operation, and always provides a preferable state for the recording head 7. With the above described configuration and operation of the recording apparatus, not only can thick sheet printing and CD printing be performed easily and accurately, but also the correct performance of an operation for the cleaning unit (recovery mechanism) 6, such as the capping operation or the wiping operation, is ensured, and the recording head 7 can be maintained in a preferable recording standby state.

In the above embodiments, an explanation has been given for the ink jet recording apparatus. However, the present invention can also be applied for a recording apparatus of another recording type, such as a wire-dot impact type, a photosensitive type or a laser beam type, and the same effects can be obtained. Further, the present invention can also be applied for a recording apparatus that performs monochromatic recording, a color recording apparatus that employs one or more recording heads to record data using multiple, different colors, a tone recording apparatus that records data at multiple, differing densities using the same color, or a combination of these apparatuses. In any case, the same effects can be provided.

Moreover, in the above embodiments, an explanation has also been given for a serial recording apparatus that records data while moving in the main scanning direction the recording head used as the recording unit. However, the present invention can also be applied for a line recording system (line recording apparatus) that employs a line type recording head that covers all of or a part of the width of a recording material, and records data by moving the recording head only in the sub-scanning direction. In this case, the same effects can also be obtained.

Furthermore, the present invention can be applied for an ink jet recording apparatus using liquid ink, regardless of the arrangements used for a recording head and ink tanks, including an arrangement that employs an exchangeable head cartridge that integrally includes a recording head and an ink tank, or an arrangement for which a recording head and an ink tank are separately provided and are connected by an ink supply tube. In any case, the same effects can be acquired as those obtained in the embodiments. Further, the present invention can also be applied for an ink jet recording apparatus that includes a recording unit that employs an electric-mechanical converting member such as a piezoelectric device. Above all, the present invention is effective for an ink-jet recording apparatus that employs a recording unit that uses thermal energy to eject ink, because high recording density and high resolution can be obtained.

What is claimed is:

1. A recording apparatus, for causing a recording unit to record on a sheet or a disc, comprising:

a carriage for mounting the recording unit thereon and for conveying the recording unit;

a guide member for guiding the conveyance of said carriage;

a platen for guiding a rear surface of the sheet or a tray on which the disc is mounted, at a position opposed to the recording unit;

a lifting mechanism for changing an interval between the recording unit and said platen, said lifting mechanism being capable of lifting said guide member irrespective of a position of said carriage;

a cleaning unit for maintaining/recovering a function of the recording unit; and control means for changing the interval between the recording unit and said platen to a predetermined one when said cleaning unit executes a cleaning operation.

2. A recording apparatus according to claim 1, wherein the recording unit is movable in a heightwise direction, and wherein, before a recording operation is initiated, the position of the recording unit is progressively changed in the heightwise direction, and the recording unit is returned to the initial height position before the cleaning operation is initiated.

3. A recording apparatus according to claim 2, wherein height positions for the recording unit comprise a normal position for performing recording on the sheet, and a CD position for performing recording on the disc mounted on the tray.

4. A recording apparatus according to claim 2, wherein height positions for the recording unit comprise a normal position for performing recording on the sheet and a thick sheet position for performing recording on the disc mounted on the tray.

5. A recording apparatus according to claim 1, wherein a separation instruction for use in controlling the height position of the recording unit is issued by a signal transmitted by a host.

6. A recording apparatus according to claim 1, wherein a separation instruction for use in controlling the height position of the recording unit is issued by a signal based on a sensor in the recording apparatus.

7. A recording apparatus according to claim 1, wherein said cleaning unit includes a capping member for covering the recording unit and a wiping member for wiping the recording unit.

8. A recording apparatus according to claim 1, further comprising a discharge roller for discharging the sheet, and a spur driven to rotate by the discharge roller wherein the discharge roller and the spur are separated from each other when recording is performed on a disc.

* * * * *